US008247760B2

(12) United States Patent
David et al.

(10) Patent No.: US 8,247,760 B2
(45) Date of Patent: Aug. 21, 2012

(54) ATOM CHIP DEVICE

(75) Inventors: Tal David, Beer-sheva (IL); Yonathan Japha, Rehovot (IL); Valery Dikovsky, Beer Sheva (IL); Ron Folman, Rehovot (IL)

(73) Assignee: Ben-Gurion University of the Negev, Beer Sheva (IL)

( * ) Notice: Subject to any disclaimer, the term of this patent is extended or adjusted under 35 U.S.C. 154(b) by 211 days.

(21) Appl. No.: 12/675,790

(22) PCT Filed: Aug. 11, 2008

(86) PCT No.: PCT/IL2008/001104

§ 371 (c)(1),
(2), (4) Date: Aug. 17, 2010

(87) PCT Pub. No.: WO2009/027966

PCT Pub. Date: Mar. 5, 2009

(65) Prior Publication Data

US 2010/0320995 A1 Dec. 23, 2010

Related U.S. Application Data

(60) Provisional application No. 60/969,218, filed on Aug. 31, 2007.

(30) Foreign Application Priority Data

Feb. 5, 2008 (IL) ..... 189283

(51) Int. Cl.
*H05H 3/00* (2006.01)

(52) U.S. Cl. ..... 250/251; 252/503; 324/78

(58) Field of Classification Search ..... 250/251
See application file for complete search history.

(56) References Cited

U.S. PATENT DOCUMENTS

| | | | | |
|---|---|---|---|---|
| 7,238,594 | B2 * | 7/2007 | Fonash et al. | 438/478 |
| 2007/0092432 | A1 | 4/2007 | Prud'Homme | |
| 2007/0154755 | A1 | 7/2007 | Wardrop | |

FOREIGN PATENT DOCUMENTS

| | | |
|---|---|---|
| WO | WO2006/085299 | 8/2006 |

OTHER PUBLICATIONS

M. Bartenstein et al "Atoms and Wires: Toward Atom Chips", IEEE Journal of Quantum Electronics, 36, pp. 1364, 2000.*
Kuntscher et al; "Extremely Small Energy Gap in the Quasi-One-Dimensional Conducting Chain Compound SrNbO3.41", Phys. Rev. Letter, vol. 89, Issue 23, Dec. 2, 2002.
International Search Report for PCTIL2008001104.

* cited by examiner

*Primary Examiner* — Phillip A Johnston
(74) *Attorney, Agent, or Firm* — Graeser Associates International Inc; Dvorah Graeser

(57) ABSTRACT

Ultra-cold (nano-Kelvin) neutral atoms can be trapped, manipulated, and measured, using integrated current carrying micro-structures on a nearby surface (Atom Chips). This can be utilized for the realization of ultra-sensitive sensors and quantum computation devices based on the quantum mechanical properties of the trapped atoms. However, harmful processes arise from the interactions between the atoms and the nearby surface. According to the present invention these harmful processes can be highly suppressed by using electrically anisotropic materials. It is shown that time-independent trapping potential corrugation leading to fragmentation of the trapped atom cloud can be suppressed, and that time dependent noise processes arising from the coupling of atoms to the nearby surface, and leading to loss of atoms from the trap, heating and loss of coherence can be significantly reduced.

19 Claims, 7 Drawing Sheets

ATOM CHIP DEVICE

REFERENCE TO CROSS-RELATED APPLICATION

This application claims the benefit of all of PCT Application No. PCT/IL2008/001104, filed on Aug. 11 2008, which claims priority from Israeli Application No. IL 189283, filed Feb. 5, 2008, and from U.S. Provisional Application No. 60/969,218 filed Aug. 31, 2007, all of which are hereby incorporated by reference as if fully set forth herein.

FIELD OF THE INVENTION

The present invention relates to an atom chip device and, in particular to an atom chip device that suppresses the heating and decoherence rates of cold neutral atoms, which are trapped in an atom micro-trap, as well as suppress fragmentation of the atom cloud, with respect to existent atom chip devices that include pure metal components, by use of electrically anisotropic materials.

BACKGROUND OF THE INVENTION

The atom chip is a device aimed at realizing quantum technology devices in which the rules of quantum mechanics are used to realize applications such as ultra sensitive clocks, gravitation and acceleration sensors, quantum cryptography (secure communications), and quantum computing, to name a few.

A typical, conventional atom chip is composed of a substrate upon which an electrically conductive functional layer is disposed. In the case that the substrate is not electrically insulating, a layer of electrically insulating material will be disposed between the substrate and the functional layer. The Atom Chip's conducting element, through which an electrical current flows creating a magnetic field in case of DC electrical current or electromagnetic field in case of AC electrical current, that will be referred to as internal fields, is within the functional layer, as a part of it, beneath it, or in any other suitable structure. The form of the Atom Chip's conducting element determines the distribution of potentials of the internal fields, which affect the trapping performance. This form can be Z-shaped, U-shaped, in a conveyer belt shape or in a variety of other shapes or combinations of shapes. External bias fields are necessary in many cases.

The atom chip device is located within an ultra high vacuum chamber. Commonly, the atom trapping on atom chips is by means of only magnetic fields. In the more advanced atom chip devices, atoms within the vacuum chamber are influenced by internal magnetic and electric fields, by light fields whose sources can be laser sources, some of which are reflected by the functional layer, if it has a minor nature, and by electrical fields and magnetic fields generated by elements outside of the vacuum chamber, which will be referred to as external fields. The combination of these influences, if performed correctly, traps cold neutral atoms in very close proximity to the atom chip in the atom micro-trap.

The elements of the atom chip and in particular the functional layer and the atom chip's conducting element are substantially composed of pure metals. Due to harmful effects such as magnetic thermal noises, as well as background noises, the time interval of the atom trapping is limited, the atoms escape the trap, and the cloud that they create fades with time. Additionally, the atoms' temperature can increase with time (heating), and also the coherence of their quantum state may be destroyed (decoherence). The intensity of the magnetic noise increases with reduction of the distance between the trap center and the atom chip surface [5, 6].

The typical lifetime of atoms trapped at the distance of 3 μm from an atom chip surface in a conventional atom chip device is about 0.5 seconds, the magnetic noise portion in the lifetime limitation being 80%, see for example [1]. Typical heating rates for cold atoms several μm from the surface are 300-500 nK/s [2]. For isotropic materials the decoherence rates are approximately as those for trap loss rates due to spin flips (i.e. in the above example 2 $s^{-1}$) [2]. Reduction of the magnetic noise is needed for all applications of the atom chip. For example, it is important for a quantum gravity gradiometer, where the atom chip is used as an interferometer based gravity sensor. The sensitivity of this device is limited by the magnetic noise [7]. For an atomic clock the magnetic noise limits the frequency stability, which determines the atomic clock precision [8].

Apart from magnetic noise, imperfections in the current-carrying elements on the atom chip lead to time-independent corrugation of the magnetic trapping potential, affecting the density profile of the atom cloud, up to a point where the cloud can break-up into smaller clouds (fragmentation). Fragmentation is directly related to current flow in the current-carrying structures [30], and becomes worse as the atom-surface distance becomes smaller. This corrugation limits on the ability to create extremely tight and smooth trapping potentials.

PCT patent application PCT/IL2006/000118, filed 29.01.2006, which is incorporated by reference for all purposes as if fully set forth herein, describes an atom chip device, whose magnetic noise level is significantly less than that which could be achieved previously in atom chip devices.

There is thus a widely recognized need for, and it would be highly advantageous to have an atom chip device, whose magnetic noise level would be significantly less than that which can currently be achieved in existent atom chip devices.

SUMMARY OF THE INVENTION

It is an object of the present invention to provide an atom chip device that significantly reduces the heating- and decoherence-rates of the atom cloud trapped in close proximity to it, increases the trap lifetime, as well as suppresses fragmentation.

An atom chip device and a method for trapping, manipulating and measuring atoms in an ultra high vacuum chamber, for reducing the heating and decoherence rates of the trapped atoms, for increasing trap lifetime, and for suppressing time-independent spatial magnetic potential corrugations (fragmentation), the atom chip device according to the present invention including at least one conductive element, wherein at least part of the element is an electrically anisotropic material, and wherein at least one conductive element has a low working temperature.

According to the present invention there is provided an atom chip device for trapping, manipulating and measuring atoms in an ultra high vacuum chamber, for reducing heating and decoherence rates, for increasing the lifetime of the trapped atoms, and for suppression of atom cloud fragmentation, the atom chip device including: (a) at least one atom chip conductive element, having a flat surface, wherein the at least one atom chip conductive element is made of metal, wherein at least part of the atom chip conductive element is an electrically anisotropic material, and wherein the at least one conductive element has a working temperature.

According to still further features in the described first embodiments of the atom chip device the reduction of heating and decoherence rates, of the trapped atoms compared with those achievable by using atom chip device having conductive elements made of pure metals is at least smaller by a factor of 100, the atom chip device further including: (b) an atom chip functional layer, having a flat surface, wherein the atom chip functional layer is made of metal, wherein at least part of the metal is made of an electrically anisotropic material, and wherein the atom chip functional layer is isolated electrically from the conductive element.

According to still further features in the described first embodiments of the atom chip device further including: (c) an atom chip substrate, wherein the atom chip substrate gives mechanical strength to the atom chip device; and (d) an atom chip insulated layer, disposed on the atom chip substrate, wherein the atom chip insulated layer electrically insulates the at least one conductive element from the functional layer.

According to still further features in the described first embodiments of the atom chip device, the at least one atom chip conductive element's flat surface and the functional layer's flat surface are substantially on the same plane.

According to still further features in the described first embodiments of the atom chip device, the atom chip device further including: (e) at least two atom chip conductive elements, having flat surfaces.

According to still further features in the described first embodiments of the atom chip device, the atom chip conductive element and the atom chip functional layer are both substantially made of the electrically anisotropic material.

According to still further features in the described first embodiments of the atom chip device, the at least one atom chip conductive element's working temperature is less than room temperature.

According to still further features in the described first embodiments of the atom chip device, the at least one atom chip conductive element has a geometric shape selected from a group consisting of a straight line, Z-shape, conveyer belt shape, or U-shape.

According to still further features in the described first embodiments of the atom chip device, the at least one atom chip conductive element has a geometric Z-shape.

According to still further features in the described first embodiments of the atom chip device, the at least one atom chip conductive element has a geometric U-shape.

According to still further features in the described first embodiments of the atom chip device, the at least one conductive element has a geometric conveyer belt shape.

According to still further features in the described first embodiments of the atom chip device, the at least one atom chip conductive element is made of an electrically anisotropic material that has, at the working temperature, lower resistivity and temperature/resistivity ratio values than both resistivity and temperature/resistivity ratio values of gold at room temperature.

According to still further features in the described first embodiments of the atom chip device, the at least one atom chip conductive element's electrically anisotropic material is made of hyper-oriented pyro-graphite (HOPG), having anisotropy ratio $\rho_c/\rho_a$ of approximately 3750 at room temperature.

According to still further features in the described first embodiments of the atom chip device, the at least one atom chip conductive element's electrically anisotropic material is made of $SrNbO_{3.41}$, having an a-axis resistivity of $\rho_a=4.6\cdot10^{-4}$ Ωcm and anisotropy ratio $\rho_a:\rho_b:\rho_c$ of approximately $1:10^2:10^4$ at room temperature (300K), and $\rho_a=2.7\cdot10^{-3}$ Ωcm and anisotropy ratio $\rho_a:\rho_b:\rho_c$ of approximately $1:37:10^5$ at approximately 7.5 K.

According to a second embodiment of the invention an atom chip device for trapping, manipulating and measuring atoms in ultra high vacuum chamber, for reducing of heating- and decoherence-rates and for increasing the lifetime of the trapped atoms, the atom chip device including: (a) at least one atom chip conductive element, having a flat surface, wherein the at least one atom chip conductive element is made of metal, wherein at least part of the metal is an electrically anisotropic material, and wherein the at least one atom chip conductive element has a working temperature, wherein the at least one atom chip conductive element working temperature is less than room temperature, wherein the at least one atom chip conductive element has a geometric shape selected from a group consisting of a straight line, Z-shape, conveyer belt shape, or U-shape, and wherein the at least one atom chip conductive element's is made of an electrically anisotropic material having both resistivity and temperature/resistivity ratio values at the working temperature lower than both resistivity and temperature/resistivity ratio values of gold at room temperature; (b) an atom chip functional layer, having a flat surface, wherein the atom chip functional layer is made of metal, wherein at least part of the metal is an electrically anisotropic material, and wherein the atom chip functional layer is electrically isolated from the conductive element; (c) an atom chip substrate, wherein the atom chip substrate gives mechanical strength to the atom chip device; and (d) an atom chip's first insulated layer, disposed on the substrate, wherein the atom chip's first insulated layer electrically insulates the at least one conductive element from the functional layer.

According to a further features in the described second embodiments of the atom chip device, the at least one atom chip's first conductive element's electrically anisotropic material is made of hyper-oriented pyro-graphite (HOPG), having anisotropy ratio $\rho_c/\rho_a$ of approximately 3750 at room temperature.

According to still further features in the described embodiments of the atom chip device, the at least one atom chip's first conductive element's electrically anisotropic material is made of $SrNbO_{3.41}$, having an a-axis resistivity of $\rho_a=4.6\cdot10^{-4}$ Ωcm and anisotropy ratio $\rho_a:\rho_b:\rho_c$ of approximately $1:10^2:10^4$ at room temperature (300K), and $\rho_a=2.7\cdot10^{-3}$ Ωcm and anisotropy ratio $\rho_a:\rho_b:\rho_c$ of approximately $1:37:10^5$ at approximately 7.5 K.

According to the present invention there is provided a method of trapping, manipulating and measuring atoms including the stages of: (a) providing an atom chip device including: (i) at least one atom chip conductive element, having a flat surface, wherein the at least one atom chip conductive element is made of metal, wherein at least part of the metal is an electrically anisotropic material, wherein the at least one atom chip conductive element has a working temperature, wherein the at least one atom chip conductive element working temperature is less than room temperature, wherein the at least one atom chip conductive element has a geometric shape selected from a group consisting of a straight line, Z-shape, conveyer belt shape, or U-shape, and wherein the at least one conductive element's dilute alloy metal is made of an alloy having both resistivity and temperature/resistivity ratio values at temperature lower than both resistivity and temperature/resistivity ratio values of gold at room temperature; (ii) an atom chip functional layer, having a flat surface, wherein the atom chip functional layer is made of metal, wherein at least part of the metal is an electrically anisotropic material, and wherein the functional layer is electrically isolated from the conductive element; (iii) an atom chip substrate, wherein the atom chip substrate gives mechanical strength to the atom chip device; and (iv) an atom chip's first insulated layer, disposed on the atom chip substrate, wherein the atom chip's first insulated layer electrically insulates the at least one atom chip's first conductive element from the functional layer; (b) installing the atom chip device inside a chamber, at room temperature and at room pressure, wherein the chamber has the structure of an ultra high vacuum chamber; (c) closing and sealing the chamber; (d) lowering the pressure inside the chamber; (e) supplying atoms to the inside of the chamber; and (f) connecting the at least one atom chip's first conductive element to an electricity source.

According to further features in the described embodiments of the described method, the method of trapping, manipulating and measuring atoms further including the stage of: (g) lowering the temperature of the at least one atom chip's first conductive element.

BRIEF DESCRIPTION OF THE DRAWINGS

The invention is herein described, by way of example only, with reference to the accompanying drawings, wherein.

DETAILED DESCRIPTION OF EMBODIMENTS

Figure 1A:
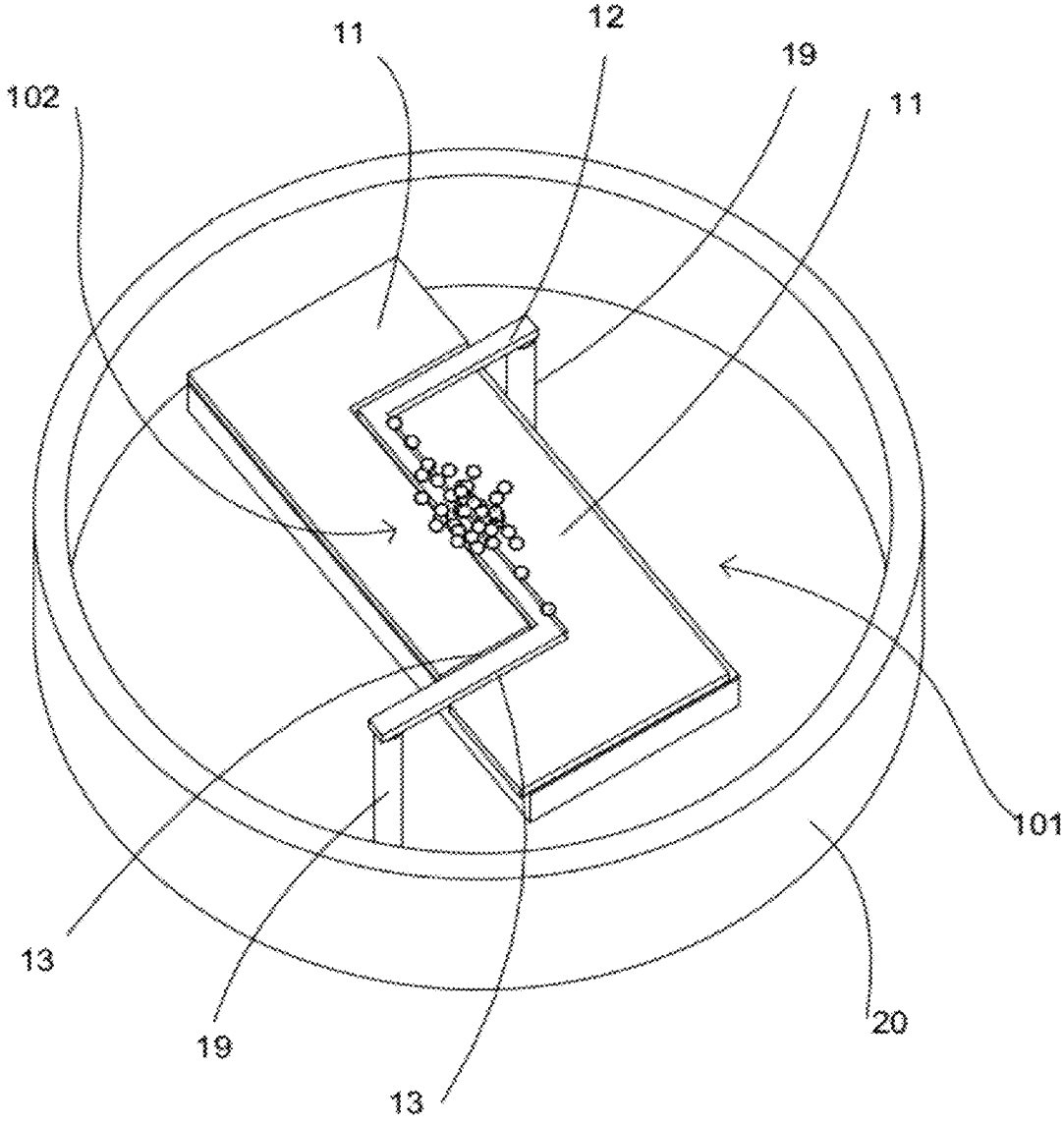
FIG. 1*a* is a schematic perspective view illustration of a first embodiment of an atom chip device within a vacuum chamber of the present invention. The conductive element is at least partially made of an anisotropic material.

The present invention is an atom chip device, and in particular an atom chip device with electrically anisotropic material elements, reducing heating and decoherence-rates of trapped atoms, suppressing time-independent spatial corrugations of the magnetic trapping potential (fragmentation), and extending the lifetime of the trapped atoms when working at a low temperature.

The principles and operation of an atom chip device according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings.

Unless otherwise defined, all technical and scientific terms used herein have the same meaning as commonly understood by one of ordinary skill in the art to which this invention belongs. The materials, dimensions, methods, and examples provided herein are illustrative only and are not intended to be limiting.

The present invention may be better understood with reference to the following scientific papers:

List Of References

[1] Y. Lin, I. Teper, C. Chin, and V. Vuletić. Phys. Rev. Lett. 92, 020404 (2004);

[2] R. Folman, P. Kruger and J. Schmiedmayer, J. Denschlag and C. Henkel, Adv. At. Mol. Opt. Phys. 48, 263-365, (2002);

[3] R. Folman and J. Schmiedmayer, Nature 413, 466 (2001);

[4] P. Kruger Ph.D. thesis, Heidelberg (2004);

[5] C. Henkel, S. Pötting, and M. Wilkens, Appl. Phys. B 69, 379 (1999);

[6] C. Henkel, S. Pötting, Appl. Phys. B 72, 73-80 (2001);

[7] A. B. Matsko, N. Yu, and L. Maleki, *Phys. Rev. A* 67, 043819 (2003);

[8] P. Treutlein, P. Hommelhoff, T. Steinmetz, T. W. Hansch, and J. Reichel, Phys. Rev. Lett. 92, 203005 (2004);

[9] S. Aigner, L. Della Pietra, Y. Japha, O. Entin-Wohlman, T. David, R. Salem, R. Folman, and J. Schmiedmayer, Science, 319, 1226 (2008);

[10] Y. Japha et al., Phys. Rev. B 77, 201407(R) (2008);

[11] E. M. Lifshitz, Soy. Phys. JETP 2, 73 (1956); J. Exp. Theor. Phys. USSR 29, 94 (1955);

[12] C. Henkel, P. Kruger, R. Folman, and J, Schmiedmayer, Appl. Phys. B 76, 174 (2003);

[13] C. D. J. Sinclair, E. A. Curtis, I. Llorente-Garcia, J. A. Retter, B. V. Hall, S. Eriksson, B. E. Sauer and E. A. Hinds, PRA 72, rapid communication (2005); C. D. J. Sinclair, J. A. Retter, E. A. Curtis, B. V. Hall, I. Llorente-Garcia, S. Eriksson, B. E. Sauer and E. A. Hinds, Eur. Phys. J. D. 35, 105-110 (2005);

[14] S. Wildermuth, S. Hofferberth, I. Lesanovsky, E. Haller, M. Andersson, S. Groth, I. Bar-Joseph, P. Krüger and J. Schmiedmayer Nature 435, 440 (2005);

[15] S. Groth, P. Kruger, S. Wildermuth, R. Folman, T. Fernholz, D. Mahalu, I. Bar-Joseph and J. Schmiedmayer, Appl. Phys. Lett. 85, 14 (2004);

[16] PCT patent application PCT/IL2006/000118, filed at 29.01.2006; V. Dikovsky, Y. Japha, C. Henkel, and R. Folman, Eur. Phys. J. D. 35, 87 (2005), Special issue on atom chips;

[17] L. Edman, B. Sundqvist, E. McRae, and E. Litvin-Staszewska, Phys. Rev. B. 57, 6227 (1998);

[18] B. A. Sanborn, P. B. Allen, and D. A. Papaconstantinopoulos, Phys. Rev. B. 40(9), 6037 (1989);

[19] D. G. Schlom, S. B. Knapp, S. Wozniak, L.-N. Zou, J. Park, M. E. Hawley, G. W. Brown, A. Dabkowski, H. A. Dabkowska, R. Uecker, and P. Reiche, Supercond Scitechnol 10, 891 (1997);

[20] A. W. Tyler, A. P. Mackenzie, S. NishiZaki, Y. Maeno, Phys. Rev. B. 58, R10107 (1998);

[21] T. Katsufuji, M. Kasai, and Y. Tokura, Phys. Rev. Lett. 76, 126 (1995);

[22] R. J. Cava, B. Batlogg, K. Kiyono, H. Takagi, J. J. Krajewski, W. F. Peck, Jr., L. W. Rupp, Jr., and C. H. Chen, Phys. Rev. B. 49, 11890 (1994);

[23] S.-I. Ikeda, Y. Maeno, S. Nakatsuji, M. Kosaka, and Y. Owatoko, Phys. Rev. B. 62, R6089 (2000);

[24] N. Motoyama, T. Osafune, T. Kakeshita, H. Eisaki, and S. Uchida, Phys. Rev. B. 55, R3386 (1997);

[25] V. N. Zavaritsky, A. S. Alexandrov, preprint: arXiv: cond-mat/0410075;

[26] K. Takenaka, K. Mizuhashi, H. Takagi, and S. Uchida, Phys. Rev. B. 50, 6534 (1994);

[27] SPI supplies, http://www.2spi.com/catalog/new/hopg-sub.shtml;

[28] C. A. Kuntscher, D. van der Marel, M. Dressel, F. Lichtenberg, and J. Mannhart, Phys. Rev. B. 67, 035105;

[29] C. A. Kuntscher, S. Schuppler, P. Haas, B. Gorshunov, M. Dressel, M. Grioni, F. Lichtenberg, A. Herrnberger, F. Mayr, and J. Mannhart, Phys. Rev. Lett. 89, 236403 (2002);

[30] S. Kraft, A. Günther, H. Ottl, D. Wharam, C. Zimmermann and J. Fortägh, J. Phys. B: At. Mol. Opt. Phys. 35 (2002) L469-L474;

[31] J.-B. Trebbia, C. L. Garrido Alzar, R. Cornelussen, C. I. Westbrook, I. Bouchoule, preprint: arXiv quant-ph/0701207 (2007);

[32] S. Aubin, S. Myrskog, M. H. T. Extavour, L. J. LeBlanc, D. McKay, A. Stummer, and J. H. Thywissen, Nature Physics 2, 384-387 (2006);

[33] S. Hofferberth, I. Lesanovsky, B. Fischer, J. Verdu and J. Schmiedmayer, Nature Physics, DOI: 10.1038/nphys420; arXiv: quant-ph/0608228;

[34] S. Hofferberth, B. Fischer, T. Schumm, J. Schmiedmayer, I. Lesanovsky, Phys. Rev. A 76, 013401 (2007);

[35] A. Haase, B. Hessmo and J. Schmiedmayer, Optics Letters, Vol. 31, Issue 2, pp. 268-270 (2006);

[36] S. Wildermut, S. Hofferberth, I. Lesanovsky, S. Groth, I. Bar-Joseph, P. Krüger and J. Schmiedmayer, Appl. Phys. Lett. 88, 264103 (2006);

[37] P. Kruger, L. M. Andersson, S. Wildermuth, S. Hofferberth, E. Haller, S. Aigner, S. Groth, I. Bar-Joseph and J. Schmiedmayer, arXiv:cond-mat/0504686;

[38] T. Schumm, J. Estëve, C. Figl, J.-B. Trebbia, C. Aussibal, H. Nguyen, D. Mailly, I. Bouchoule, C. I. Westbrook and A. Aspect, preprint: arXiv physics/0407094;

[39] J. Estéve, C. Aussibal, T. Schumm, C. Figl, D. Mailly, I. Bouchoule, C. I. Westbrook and A. Aspect, prepript: arXiv physics/0403020;

[40] D.-W. Wang, M. D. Lukin, and E. Demler, Phys. Rev. Lett. 92 (7), 076802 (2004);

[41] A. E. Leanhardt, Y. Shin, A. P. Chikkatur, D. Kielpinski, W. Ketterle, and D. E. Pritchard, Phys. Rev. Lett. 90 (10), 100404 (2003);

[42] J. M. McGuirk, D. M. Harber, J. M. Obrecht, and E. A. Cornell, preprint: arXiv cond-mat/0403254, (http://arxiv.org/PS_cache/physics/pdf/0510/0510166v1.pdf (2004);

[43] J. Fortagh, H. Ott, S. Kraft, A. Günther, and C. Zimmermann, Phys. Rev. A 66, 041604 (2002);

[44] S. Scheel, P.-K. Rekdal, P. L. Knight, E. A. Hinds, preprint: arXiv quant-ph/0501149;

[45] P. K. Rekdal, B.-S. K. Skagerstam, U. Hohenester, A. Eiguren, preprint: arXiv quant-ph/0603229;

[46] S. Scheel, E. A. Hinds, P. L. Knight, preprint: arXiv quant-ph/0610095;

[47] B.-S. K. Skagerstam, U. h Hohenester, A. Eiguren, P. K. Rekdal, preprint: arXiv quant-ph/0610251;

[48] P. K. Rekdal, B.-S. K. Skagerstam, preprint: arXiv quant-ph/0609158; and

[49] B.-S. K. Skagerstam, P. K. Rekdal, preprint: arXiv 0706.1056.

As used herein the specification and in the claims section that follows, the terms: atom chip, magnetic atom microtrap, atom microtrap, atom chip conducting element, loss rate, lifetime, decoherence, heating, magnetic thermal noise, background noise, technical noise, dilute alloy, fragmentation, and electrically anisotropic material are as specified in the following list:

The term "atom chip" and the like substantially refer to a device for trapping and manipulating cold neutral atoms in atom microtraps above a substrate in ultra high vacuum.

The term "atom microtrap" and the like substantially refer to at least two types of trapping potentials such as magnetic, electric, and light, which result from the superposition of the magnetic, electric, and light fields near an atom chip.

The term "magnetic atom microtrap" and the like substantially refer to a trapping magnetic potential, which results from the superposition of magnetic fields near an atom chip. The source of the magnetic fields is a microfabricated wire structure carrying currents.

The terms "atom chip conducting element" and the like substantially refer to a wire of an atom chip carrying the electrical currents whose magnetic field creates at least part of a magnetic atom microtrap, and in case of an atom microtrap whose magnetic and electric fields create at least part of the atom micro trap.

The term "loss rate" and the like substantially refer to the rate of the atom quantity decreasing in the atom micro trap.

The term "lifetime" and the like substantially refer to the inverse of the loss rate, describing the time at which the number of trapped atoms has decreased to 1/e of the initial number.

The term "decoherence" and the like substantially refer to the rate of the phase coherence loss of the atoms in the atom microtrap. This means that the coherence of quantum states of the atoms, which is needed for the implementation of quantum technology, is lost.

The term "heating" and the like substantially refer to the rate of the temperature rise of the trapped atoms.

The term "magnetic thermal noise" and the like substantially refer to the harmful electromagnetic radiation in the microtrap produced by the conductive elements of the atom chip.

The term "technical noise" and the like substantially refer to the magnetic noise level due to the instability of the electrical currents in the conductive elements of the atom chip (due to imperfections in the current sources) and resulting in magnetic potential instability in the atom microtrap.

The term "background noise" and the like substantially refer to equivalent noise, which is contributed by all noise sources reducing the atom lifetime except the thermal magnetic noise. For example, the "background noise" includes, besides the technical noise, harmful electromagnetic background and equivalent noise effect due to scattering of trapped cold atoms with residual gas in the ultra high vacuum chamber.

The term "dilute alloy" and the like substantially refer to an alloy in which the solute concentration is small and the solute atom locations in the host metal structure are random.

The term "fragmentation" and the like substantially refer to the corrugation of the atom cloud spatial density profile up to a point of fragmentation into smaller clouds totally isolated from each other, arising from imperfections in the wire, leading to corrugation of the trapping potentials created by the wire in the micro-trap.

The term "electrically anisotropic material" and the like substantially refer to materials which have different electrical conductivity along different directions in the material.

The following list is a legend of the numbering of the application illustrations:

101 atom chip device
102 atom micro-trap
11 atom chip functional layer
11*a* functional layer's surface
12 atom chip conductive element
12*a* atom chip conductive element's surface
13 insulating grooves
14 cold neutral atoms
15 atom chip's first insulated layer
16 atom chip substrate
16*a* etched groove in the atom chip substrate
17 homogeneous external magnetic field
18 atom chip's second insulated layer
19 electric wires
20 ultra high vacuum chamber's wall
21 thin metal wire (of the central part of the atom chip conductive element)
22 Electron flow within the wire The use of atom chips for trapping, cooling, manipulating and measuring ultra-cold atoms near surfaces has attracted much attention in recent years [2]. The monolithically integrated micro-structures on the chip lead to extremely tight potentials, which can be tailored with length scales on the order of the atoms' de-Broglie wavelength. This enables rapidly obtaining ultra-cold quantum degenerate gases [32], and performing certain high-precision experiments such as atom interferometry [33], or to use the atoms' sensitivity to external fields as a probe for the nearby surface of the atom chip [14]. To date, atom chip traps are mostly magnetic. However the use of electrostatic, radio-frequency (RF), or light potentials for atom manipulation on atom chips is also evolving rapidly (e.g. [34-36]). The chip platform is also considered as a candidate for the development of quantum technologies in the field of quantum information processing and communication, as well as in interferometry based sensors. However, the advantages of being in close proximity to the surface are hindered by harmful processes originating from the surface itself, which currently limit the capabilities of this platform [12].

Time-independent spatial fluctuations of electron flow in the current carrying structures on the chip, originating either from surface or edge roughness or from bulk inhomogeneities due to imperfections in the fabrication, lead to corrugation of the magnetic trapping potential [37]. The consequence to the atom cloud is a variation in the density profile corresponding to the trapping potential, up to the point of fragmentation of the atom cloud into several small clouds along the trapping guide, totally separated from each other. Fragmentation was shown to be directly connected to electron flow in the trapping wires [30]. In most studies on this issue (theoretical and experimental) [38-40], the local field variations leading to the fragmentation were assumed to arise from a particular source: either from current fluctuations caused by randomness in the edges of the wire, from structural roughness of the wire surfaces, or from inhomogeneities in the bulk of the wire. Indeed, previous experimental manifestations of fragmentation, measured at relatively large distances away from the surface (a few tens of microns) have been interpreted as arising solely from wire edge fluctuations. In these experiments the wire had indeed been fabricated by a method leading to large edge variations [38]. However, recent progress in wire fabrication methods allows the manufacturing of wires with a much lower amount of edge roughness. Moreover, several experiments have been carried out with atoms trapped closer to the wire, such that the distance from the wire surface is much smaller than the distance to the wire edges [9]. Under such circumstances, it is plausible to expect that variations of the wire edges do not contribute significantly to the atomic potential fluctuations, while the roughness in the upper and lower surfaces, or alternatively, bulk current inhomogeneities, play a more significant role.

Several schemes have been suggested or used for reducing potential corrugation in order to suppress fragmentation. Apart from improving the fabrication of wires, using AC currents (to create a time-averaged potential) was implemented by Trebbia et al. [31], and was shown to improve the signal by two orders of magnitude. Using the same principle, it has been suggested to use RF potentials to suppress fragmentation. Recently, an observation of highly correlated patterns was seen and analyzed [9, 10], when a 1D cloud was scanned over the width of several lithography patterned wires of different characteristics. A tendency of the current in the wire to align in wave-fronts oriented at 45° relative to the direction of the wire has been observed, and shown to come out in a theoretical model developed in the Heidelberg and BGU groups. This surprising result inspired the discussion as to what can influence these patterns.

Random motion of thermal electrons within the nearby surface (Johnson or Thermal Noise) leads to magnetic field fluctuations, affecting the trapping potential and leading to trap loss due to spin flips, to heating, and to decoherence. These processes limit the lifetime of the micro-traps and the ability to perform highly sensitive experiments with long coherence times [2]. These time-dependent processes were shown to depend on the thermal noise power spectrum, in several distinct frequency ranges. For trap loss, the relevant power spectrum component in the expression of the spin flip rate is at approximately the Larmor frequency $\omega_L = \vec{\mu} \cdot \vec{B}/\hbar$, and depends on the ratio of the surface temperature to its electrical resistivity $T/\rho$ and on the geometry of the surface. Several studies were done on characterizing the lifetime of trapped atoms at different atom-surface distances, and with different material surfaces, such that the resistivity was varied [16,30,41-43]. Mostly, the geometry of the studied structures was either of a wide (effectively infinite) surface, or of rather large wires. Lowering the surface temperature was suggested by Dikovsky et al. [16], although this could work only with certain materials, which deviate from the usual linear dependence of the resistivity on temperature, such that the $T/\rho$ ratio will indeed be lowered with the temperature. In this patent application we address the resistivity factor, and study the expected noise rates in micro-traps formed near electrically anisotropic surfaces or wires. For heating, the interesting frequencies are the trap oscillation frequency or its second harmonic. At these frequencies fluctuations in the trap center-of-mass or in the trap gradients couple to the atoms and cause excitations of higher vibrational levels. Frequencies relevant to decoherence are either of the above, the Larmor frequency for spin coherence, and the vibrational frequencies for spatial coherence.

Electrically anisotropic materials are ones that have a tensorial conductivity (or resistivity) and not a scalar one, i.e. they have different conductance in the different crystal axes. The rather wide variety of such materials, including ruthenates, cuprates, graphites and others, was studied thoroughly, but not in the context of surface atom optics or atom-surface interactions. In this patent application we generalize the present theory to include electrically anisotropic materials, and analyze their affect on time-dependent and time-independent processes. In regards to fragmentation, we will show that the characteristic orientation of organized patterns of electron flow within micro-wires can be changed, scaling as a power law in respect to the electrical anisotropy, and that for high anisotropy fragmentation is expected to be highly suppressed. This is done at room temperature or at a low temperature, using simple DC currents, with no modulations of the trapping potential. Regarding thermal noise, we show that using electrically anisotropic materials leads to a significant improvement in the trap lifetime when the surface is cooled to cryogenic temperatures, and a significant improvement to heating- and decoherence-rates is expected to be achieved even at room temperature. When the surface is cooled below room temperature, the spin-flip loss-rate is reduced; hence the lifetime is extended, up to several orders of magnitude, when background noise is absent.

We begin by deriving the generalized formalism of time-independent corrugation of the trapping potential due to imperfection in micro-wires leading to fragmentation, and point to the differences between the isotropic and anisotropic cases. We discuss scaling laws and analyze the organized current flow patterns as a function of the anisotropy, for different types of anisotropic materials. We then move to discuss the affect of using anisotropic materials on the thermal noise produced by a surface, and analyze its effect on trap lifetime, heating, and decoherence. We discuss issues of materials and fabrication, important for the design of experiments to test the theory.

Referring now to the drawings, FIG. 1*a* is a schematic perspective view illustration of a first embodiment of an atom chip device 101 within an ultra high vacuum chamber of the present invention. The illustration shows ultra high vacuum chamber's wall 20 in which atom chip device 101 and atom microtrap 102 are located. The atom chip device 101 includes the atom chip functional layer 11 and atom chip conductive element 12, whose upper surfaces (the side facing the atom microtrap 102) are on one plane and are separated from each other by insulating grooves 13. The atom chip conductive element 12 is connected to electric wires 19 for electric feed. The atom chip functional layer 11 and the atom chip conductive element 12 through which an electrical current may flow (creating a magnetic field in case of DC electrical current or electromagnetic field in case of AC electrical current), both take part in generating the magnetic and electric fields and in directing light for atom trapping. At least part of the material composing them is an electrically anisotropic material. When trapping and holding the atoms, the temperature of atom chip functional layer 11 and the atom chip conductive element 12 may be lowered below room temperature and can be as low as very few K.

The atom chip conductive element 12 can be made of an isotropic material, such as but not limited to Au, Cu, or Ti, but can also be at least partially made of an electrically anisotropic materials, such as but not limited to those shown in table 1 below. The anisotropy of electrical properties in these materials lead to a deviation of the resulting fragmentation and noise processes affecting the trapped atoms, and the result is a substantial improvement to the function of the atom chip device.

Figure 1B:
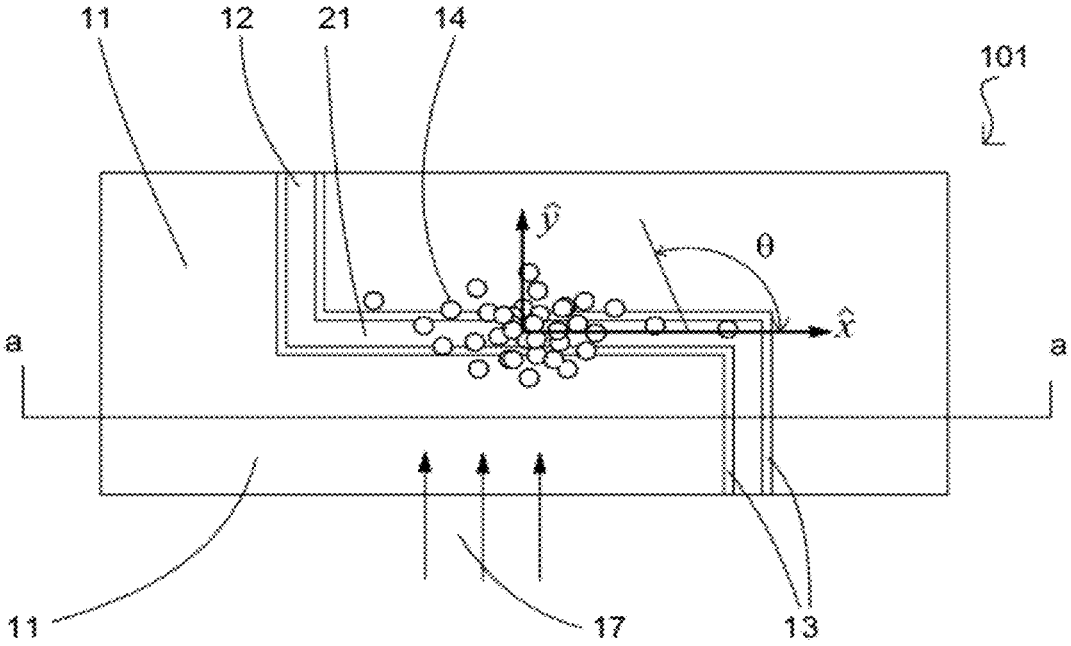
FIG. 1*b* is a schematic illustration of the first embodiment of an atom chip device of the present invention of a top view.

FIG. 1*b* is a schematic top view illustration of the first embodiment of an atom chip device 101 of the present invention, upon which a section plan a-a, a coordinate system, and an angle θ, with respect to the $\hat{x}$ direction, are marked. This illustration shows a top view of a homogeneous external magnetic field, whose source can be outside of the ultra high vacuum chamber, and which also takes part in generating the magnetic fields for trapping atoms, as well as in cold neutral atoms 14 which are trapped over the atom chip functional layer 11, the atom chip conductive element 12, and the insulating grooves 13.

The central part of the atom chip conductive element 12 is made of a thin metal wire 21 upon which a coordinate system is marked.

Figure 1C:
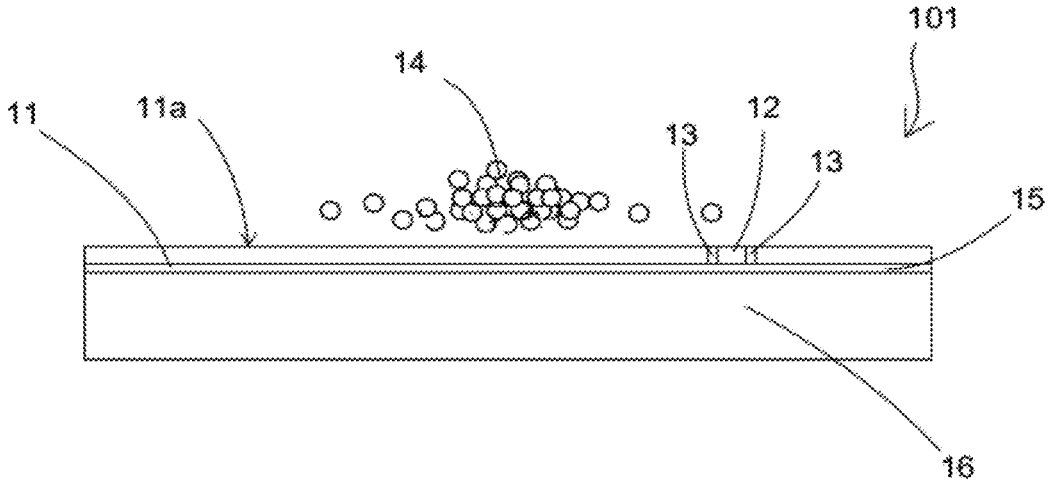
FIG. 1*c* is a schematic illustration of a side view of the first embodiment of an atom chip device of the present invention.

FIG. 1*c* is a schematic side view illustration of the first embodiment of an atom chip device 101 of the present invention. This illustration shows a side view of cold neutral atoms 14 above and in very close proximity to the plane on which the functional layer's surface 11*a* is located. The illustration also shows the atom chip substrate 16 and atom chip's first insulated layer 15 electrically insulating the atom chip functional layer 11 and the atom chip conductive element 12 from the atom chip substrate 16, which provides mechanical strength to atom chip device 101 and the atom chip conductive element 12.

Figure 1D:
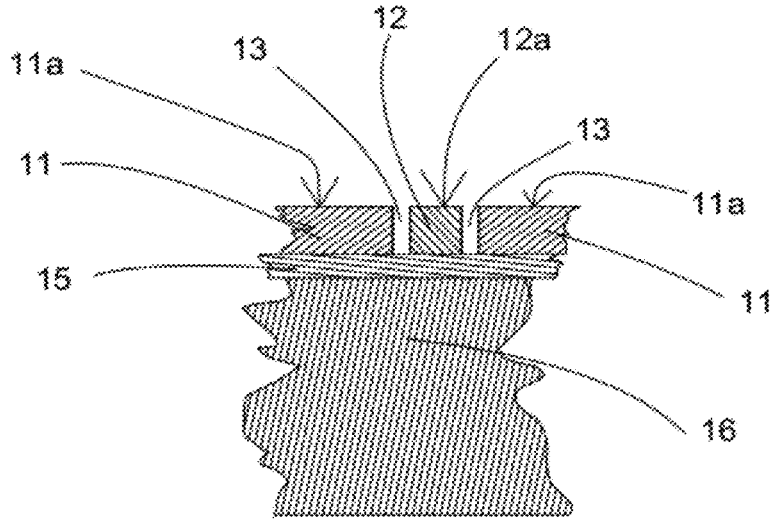
FIG. 1*d* is a schematic illustration of a detailed view of the first embodiment of the first atom chip device of the present invention in a-a cross section.

FIG. 1*d* is a schematic illustration of a detail of the first embodiment of an atom chip device 101 of the present invention in cross section a-a, and also shows the atom chip conductive element's surface 12*a* which is substantially on the same plane as the functional layer's surface 11*a*.

Figure 1E:
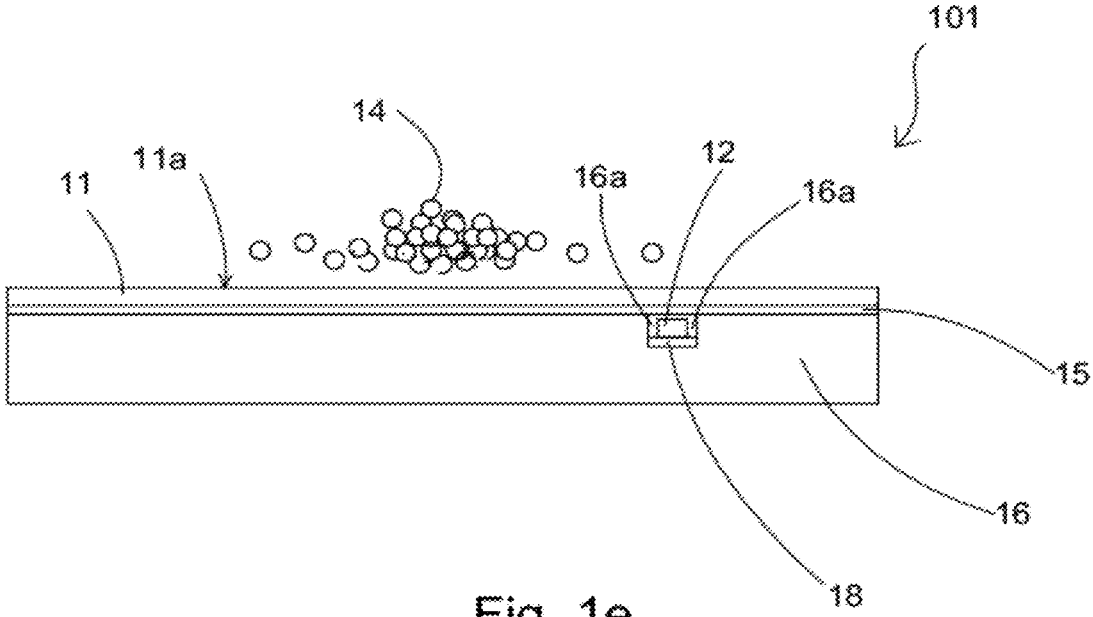
FIG. 1*e* is a schematic illustration of a side view of an additional embodiment of an atom chip device of the present invention. The conductive element is at least partially made of an anisotropic material.

FIG. 1*e* is a schematic illustration of a side view of an additional embodiment of an atom chip device 101 of the present invention. In this configuration the atom chip functional layer 11 is in one continuous layer while the atom chip conductive element 12 is under it, beneath the atom chip's first insulated layer 15 within the etched groove in the atom chip substrate 16*a* and above the atom chip's second insulated layer 18. The atom chip conductive element 12 can be made at least partially from an electrically anisotropic material.

Figure 2:
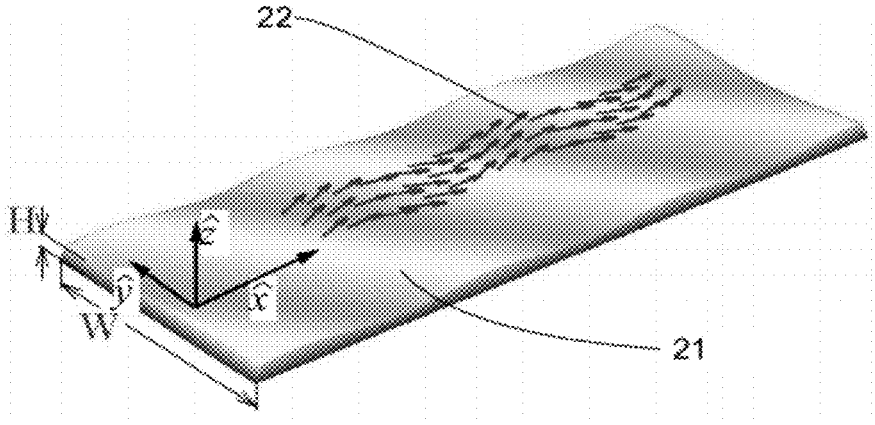
FIG. 2 is a schematic description of the geometric coordinate system of the central part of the conductive element of the first embodiment of an atom chip device according to the present invention.

FIG. 2 shows the central part of the atom chip conductive element 12 and the definitions of the geometry of the atom chip conductive element 12 with conductivity fluctuations. Electron flow within the wire 22 is illustrated, wherein the arrows represent periodic correlated electron paths with transverse amplitude with a corrugation wave-front oriented at a certain angle θ (with respect to the $\hat{x}$ direction, that is along the wire), according to the present invention.

We consider a thin metal wire 21 with bulk conductivity fluctuations, as can be seen in FIG. 2. Typical thin metal wire 21 dimensions are a width W of 200 μm and thickness H of 1 μm as considered here, without loss of generality. We define the coordinate system such that the wire length is along the $\hat{x}$ direction, its width W along the $\hat{y}$ direction, and its thickness H along $\hat{z}$. As for the anisotropic crystal used for the wire, we consider the case where the crystal axes are along the above frame of reference ('aligned' with the wire), such that the resistivity tensor is diagonal and can be written as $$\rho = \begin{pmatrix} \rho_x & 0 & 0 \\ 0 & \rho_y & 0 \\ 0 & 0 & \rho_z \end{pmatrix} \tag{1}$$

This is of course not the most general scenario, however it is sufficient to demonstrate the purpose of the present application. We can make a distinction between two types of anisotropic materials. Materials having two axes of good conductance (low resistivity) and one of bad conductance (high resistivity), i.e. $\rho_y >> \rho_x$, and $\rho_z \approx \rho_x$, will be denoted as materials having 'layered conductance'. We always assume the axis of good conductance to be along the wire, and that of bad conductance to be perpendicular to the wire axis. The other material type, in which there is only one good direction of conductance, i.e. $\rho_y >> \rho_x$, and $\rho_z \approx \rho_y$ or $\rho_z >> \rho_y$, will be denoted as having 'quasi-1D' conductance.

The generalized formalism of the organized patterns of electron flow in imperfect wires will now be derived. In the isotropic case, the derivation starts with Ohm's law $$\vec{J} = \sigma \cdot \vec{E}, \tag{2}$$

where $$\sigma = \frac{1}{\rho}$$

is the scalar conductivity, plugging it into one of the static Maxwell's equations, $$\nabla \times \vec{E} = 0. \tag{3}$$

The fluctuations $\delta\sigma(x)$ were spectrally decomposed into a sum of plane waves $$\delta\sigma(x) = \sum_{k_x, k_y} e^{i(k_x x + k_y y)} \delta\sigma(k_x, k_y).$$

Combining with the continuity equation $\vec{\nabla} \cdot \vec{J} = 0$ we obtain to first order in $\delta\sigma$ $$-\nabla^2 \delta\vec{J} = J_0 \left( \frac{\partial}{\partial x} \nabla - \hat{x} \nabla^2 \right) \frac{\delta\sigma}{\sigma_0}, \tag{4}$$

where $J_0$ is the unperturbed current density applied along the wire, and $$\sigma_0 \equiv \frac{1}{\rho_0}$$

is the unperturbed scalar conductivity. This yielded the current density fluctuation $$\delta\vec{J}(\vec{k}) = \left( \frac{\vec{k} \cdot k_x}{k^2} - \hat{x} \right) \frac{\delta\rho_k}{\rho_0} J_0, \tag{5}$$

per each $\vec{k}$ component. For a given fluctuation mode $\delta\rho_k(k_x, k_y)$ with $\vec{k} = (k_x, k_y) = k_0(\cos\theta, \sin\theta)$, $\theta$ defined as the angle from the $\hat{x}$ direction, this implies a current fluctuation in the transverse direction with angle $$\alpha_y \equiv \frac{\delta J_y}{J_0} \approx \frac{1}{2} \sin(2\theta) \frac{\delta\rho_k}{\rho_0}. \tag{6}$$

We see that the preferred angle for the current wave-fronts is at $\theta = 45°$, where the transverse currents are maximal, as was seen in the experimental results of Aigner et al. [9], and further explained by Japha et al. [10]. Conductivity fluctuations whose wave-fronts are oriented parallel or perpendicular to the main flow axis $\hat{x}$ do not generate transverse currents.

In the case of electrically anisotropic materials, the resistivity was defined in equation (1). Ohm's law (3) now takes the form $$\vec{E} = \hat{\rho} \cdot \vec{J}. \tag{7}$$

The Maxwell's equation $\nabla \times (\hat{\rho}\vec{J}) = 0$ can now be written in a tensor form as $$[\nabla \times (\hat{\rho}\vec{J})]_i = \in_{ijk} \partial_j (\rho_{kl} J_l), \tag{8}$$

where $\in_{ijk}$ is the Levi-Civita tensor. From symmetry we get $$\in_{ijk} \rho_{kl} \partial_j J_l = -\in_{ijk} (\partial_j \rho_{kl}) J_l. \tag{9}$$

Keeping on the right-hand side only the terms with $J_x = J_0$, as was done in the isotropic case, we obtain $$\in_{ijk} \rho_{kl} \partial_j J_l = \in_{ikj} (\partial_j \rho_{kx}) J_0. \tag{10}$$

Following the same logic as in the isotropic case, we combine the components of the last equation with the continuity equation $$\partial_i J_i = 0 \tag{11}$$

and analytically solve the set of equations to get the transverse components current fluctuations. We obtain $$\delta J_y = \frac{k_x \cdot k_y}{\frac{\rho_{0,y}}{\rho_{0,z}} k_z^2 + k_y^2 + \frac{\rho_{0,y}}{\rho_{0,x}} k_x^2} \cdot \frac{\delta\rho_x}{\rho_{0,x}} J_0, \tag{12}$$

which reduces to the isotropic result (5) for $\rho_{0,x} = \rho_{0,y} = \rho_{0,z} \equiv \rho_0$.

Again taking the same behavior of each $\vec{k}$ component to be as $$\vec{k} = (k_x, k_y) = k_0(\cos\theta, \sin\theta), \text{ we get} \quad \frac{\cos(\theta)\sin(\theta)}{\sin^2(\theta) + \frac{\rho_{0,y}}{\rho_{0,x}} \cos^2(\theta)} \frac{\delta\rho_x}{\rho_{0,x}} J_0. \tag{13}$$

Here it is evident that the dependence of the orientation of the current wave-fronts is different from the isotropic case. While in the limit of the isotropic case, $$\frac{\rho_{0,y}}{\rho_{0,x}} = 1,$$

we recover the $$\frac{1}{2}\sin(2\theta)$$

dependence, in the high anisotropy limit, $$\frac{\rho_{0,y}}{\rho_{0,x}} >> 1,$$

the angular dependence will asymptote to $$\frac{\tan(\theta)}{r}$$

(where $$r \equiv \frac{\rho_{0,y}}{\rho_{0,x}}),$$

which has a resonance at $\pi/2$. If we rotate the crystal axes by $\phi=90°$, i.e. now the good direction of conduction is perpendicular to the wire direction (that is, as the anisotropy ratio r <<1), we see that the tendency will be such that the angular dependence will asymptote to $$\frac{1}{r\cot(\theta)},$$

diverging as $\theta \rightarrow 0$ or $\pi$. Of course this possibility is harder to implement as the voltage needed to achieve the same current density $J_0$ in the less conducting direction is much higher. This and other issues of material and fabrication relevant to experiment design are discussed below.

We note also that for high anisotropy ratio r, we expect a competition between the divergence of the tan(θ) at $\theta \approx 90°$, and the fact that due to the large r the whole denominator leads to suppression of the entire transverse current component.

Figure 3:
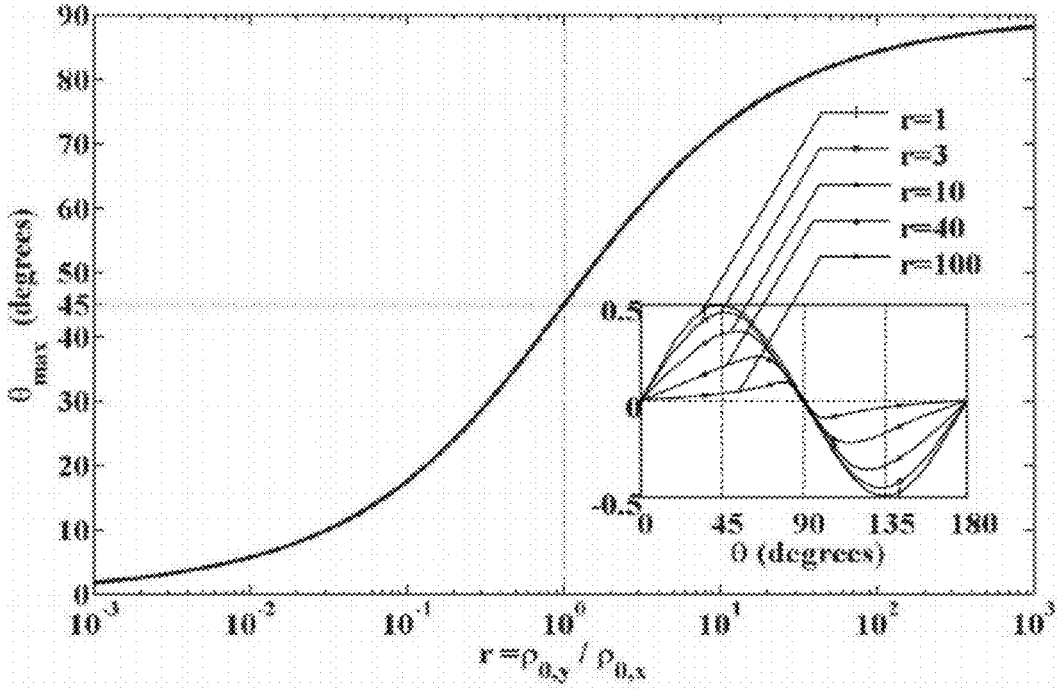
FIG. 3 shows the preferred orientation shift of patterns of current flow in the central part of the conductive element of the first embodiment of an atom chip device as a function of the electrical anisotropy according to the present invention.

FIG. 3 shows the shift of $\theta_{max}$, characterizing the preferred pattern orientation as a function of electrical anisotropy ratio $$r = \frac{\rho_{0,y}}{\rho_{0,x}},$$

according to the present invention. In the inset we plot the angular dependence of the transverse current density fluctuation $\delta J_y$ for different anisotropy ratios, according to the present invention.

Here we plot the dependence of the angular term of Eq. (13) on the anisotropy ratio r over a wide range. We see that in both regimes the scaling of the shift of the preferred orientation angle behaves as a power law.

Figure 4:
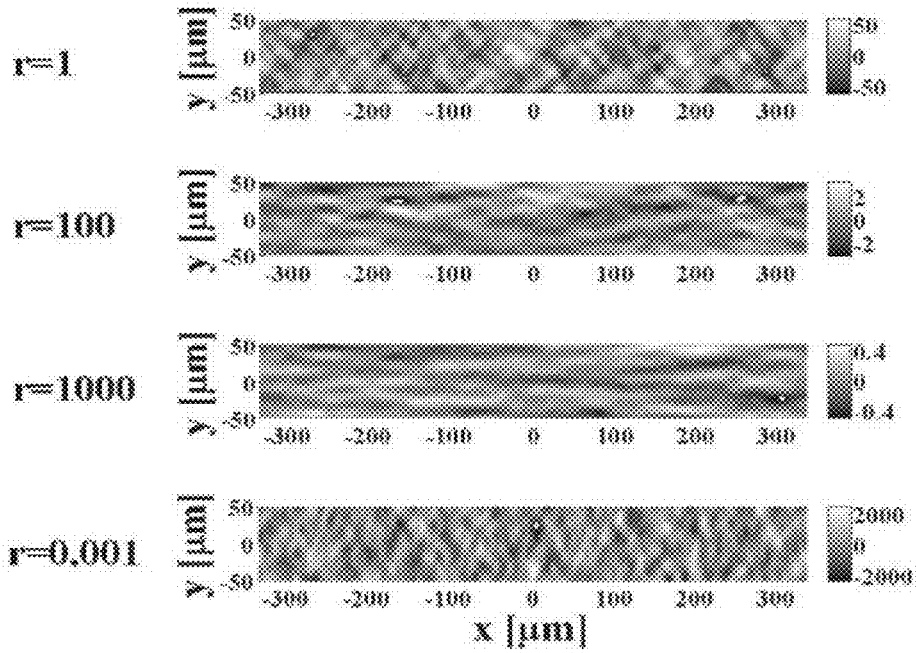
FIG. 4 is a comparison of preferred orientation patterns of electron flow wave-fronts as a function of electrical anisotropy in the central part of the conductive element of the first embodiment of an atom chip device according to the present invention.

FIG. 4 is a comparison of preferred orientation patterns of electron flow wave fronts as a function of the electrical anisotropy ratio $$r = \frac{\rho_{0,y}}{\rho_{0,x}},$$

according to the present invention.

We show simulations of the resulting magnetic field angle fluctuations, in arbitrary units, for different anisotropy ratios. The simulated wires are of width W=200 μm, thickness H=2 μm, and the observation point (atom-surface distance) is d=3.5 μm, similar to the experimental data presented in [9]. The scan is across the central 100×680 μm. The change in orientation is clearly seen, when as the anisotropy ratio is varied the angle changes from almost 0 to 90°. Note that the color scheme in these figures is false, hence for each figures we present the signal intensity in the adjoint legend.

As mentioned before, apart from the change in preferred orientation of the electron flow wave-fronts, there is also the issue of suppression of the transverse current and hence fragmentation, as can be inferred from the amplitude of the signal shown in FIG. 4.

Figure 5:
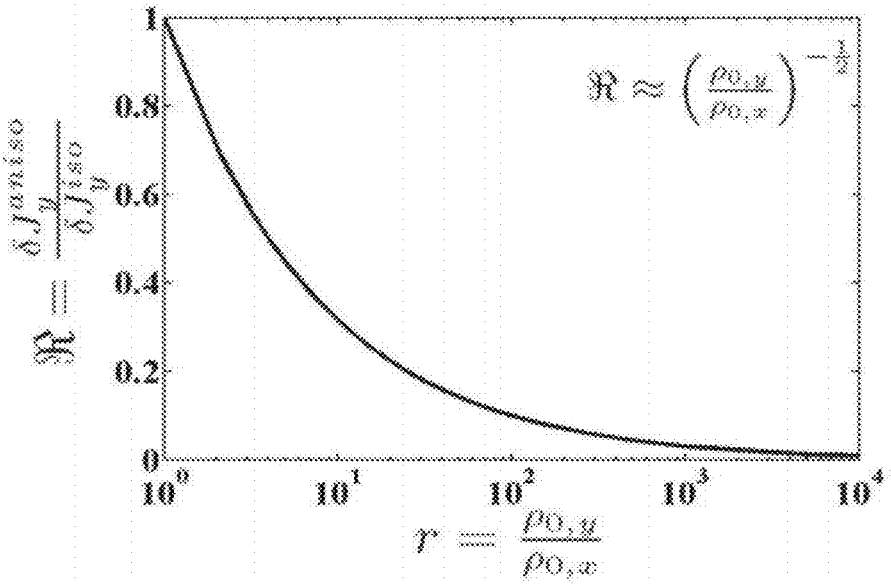
FIG. 5 shows suppression of fragmentation as a function of electrical anisotropy in the central part of the conductive element of an atom chip device according to the present invention.

FIG. 5 shows the suppression of fragmentation using electrically anisotropic wires, according to the present invention as $$r \rightarrow \infty, \Re \equiv \frac{\delta J_y^{aniso}}{\delta J_y^{iso}} \rightarrow \frac{\tan(\theta)}{r}.$$

In plotting the ratio of the transverse current density in the anisotropic case to the isotropic case $$\Re \equiv \frac{\delta J_y^{aniso}(k)}{\delta J_y^{iso}(k)},$$

we take into account that for each anisotropy ratio r the angle $\theta_{max}$ of the preferred orientation is different; hence we plot for each r the value of the transverse current at $\theta_{max}$. This implies that for the isotropic case we take $\theta=\theta_{max}^{iso}=45°$. As can be seen in the figure, while $$r \rightarrow \infty, \Re \equiv \frac{\delta J_y^{aniso}}{\delta J_y^{iso}} \rightarrow \frac{\tan(\theta)}{r},$$

the 1/r suppression of the denominator 'beats' the divergence of the tan(θ) even as it approaches $\theta_{max}=90°$. The scaling follows nicely a $r^{-1/2}$ behavior. We note, however, that in an experiment, one rather observes the angle-averaged power spectrum for which we find a scaling $$\left(\frac{\int d\theta |a^{aniso}(k,\theta)|^2}{\int d\theta |a^{iso}(k,\theta)|^2}\right)^{1/2} \propto r^{-3/4} \tag{14}$$

in the high anisotropy limit r>>1. Hence, we see that using highly anisotropic materials for trapping wires may have an advantage of suppressing fragmentation quite strongly. This is without a need for any kind of modulation of the trapping fields, only using the same DC currents normally applied.

Time-dependent harmful processes affecting the atoms limit the time and sensitivity of possible experiments. As generally the atom-surface distance dependence is such that the noise becomes larger as the atoms are closer to the surface, it follows also that thermal noise limits the possible trap height, hence the ability to tailor steep potentials with a typical length scale down to the atoms' wavelength. Presently, most theory and experiments done focused on trap loss due to thermal noise inducing spin flips of the atoms into untrapped states. The affect of changing the surface material (metals, dielectrics, permanent magnets) has been investigated, and the theory was found to fit well to experimental data.

Recently some theoretical effort was done as to the expected improvement to the trap loss rate due to thermal noise, when the surface is made of either certain metal alloys [16], or superconductors [44-49], while cooling the surface to cryogenic temperatures. In this section we discuss a generalized formalism of present theory to include the case of electrically anisotropic materials, and discuss not only the implications regarding loss rate, but also heating and decoherence.

As mentioned before, the random motion of thermal electrons in the finite temperature surface of the atom chip leads to fluctuations in the trapping potential. These fluctuations couple to the atoms through their magnetic dipole moment, and can result in the atoms flipping their spin from a trapped state to an untrapped state, and be immediately lost from the trap. In this section we will generalize the derivation for the spin flip rate due to thermal noise to include the case of anisotropic materials.

Following the procedure taken in Refs. [6], [16], we start by writing the spin flip rate in a Fermi's Golden Rule form $$\Gamma_{0\to f} = \sum_{i,j} \frac{\langle 0|\mu_i|f\rangle\langle f|\mu_j|0\rangle}{\hbar^2} S_B^{ij}(\omega_{0f}), \tag{15}$$

where the transition is from state |0> to state |f>, and the indices i, j represent the three spatial dimensions of the problem. $\mu_i$ is the magnetic dipole moment transition operator, which can be written for convenience as $\mu_i=\mu_B g_F F_i$, with $\mu_B$ Bohr's magneton, $g_F$ the Lánde factor of the appropriate hyperfine level, and $F_i$ the spin operator in the $i^{th}$ direction. $S_B^{ij}(\omega_{0f})$ is the spectral density of the cross correlation tensor (at the transition frequency $\omega_{0f}$, which is approximately the Larmor frequency for the case of spin flips), holding the important parameters of the problem. It was shown [6] that for the isotropic case, in a local theory for homogeneous metallic structures, this cross correlation tensor is of the form $$S_B^{ij}(\vec{x}_1, \vec{x}_2; \omega) = S_B^{bb}(\omega)\frac{3Im\epsilon}{4\pi\omega/c} Y_{ij}, \tag{16}$$

where the power spectrum was normalized to Planck's blackbody formula $$S_B^{bb} = \frac{\hbar\omega^3}{3\pi\epsilon_0 c^5\left(e^{\frac{\hbar\omega}{k_B T}} - 1\right)}, \tag{17}$$

and $Y_{ij}$ being a geometrical tensor describing the system $$Y_{ij} = \delta_{ij} tr(X_{ij}) - X_{ij} \tag{18}$$

$$X_{ij} = \int_V d^3x' \frac{\left(\vec{x}_1 - \vec{x}'\right)\left(\vec{x}_2 - \vec{x}'\right)}{\left|\vec{x}_1 - \vec{x}'\right|^3\left|\vec{x}_2 - \vec{x}'\right|^3}$$

In the quasi-static approximation, wherein retardation effects are not considered and the relevant frequencies are low enough such that the Planck's function can be taken to the high-temperature limit, the expression (16) becomes $$S_B^{ij} = \frac{k_B T}{4\pi^2\epsilon_0^2 c^4 \rho} Y_{ij}, \tag{19}$$

where the dielectric function for homogeneous metallic materials was taken as $$\epsilon(\vec{x}'; \omega) = \frac{i\sigma}{\epsilon_0\omega}, \tag{20}$$

according to the Drude model, $$\rho \equiv \frac{1}{\sigma}$$

being the DC resistivity of the surface.

In the general (anisotropic) case, we should apply the i, j indices also for the dielectric function, as the resistivity becomes a tensor. The power spectrum of the noise is related to the cross correlation function of magnetic fields according to $$\langle B_i^*(\vec{x},\omega)B_j^*(\vec{x},\omega')\rangle = 2\pi\delta(\omega-\omega')S_B^{ij}(\vec{x},\omega), \tag{21}$$

Hence this correlation function is the main quantity to be derived. To do this we use the expression for the current cross correlation function, originally formulated by Lifshitz [22], $$\langle j_i^*(\vec{x}_1,\omega)j_j^*(\vec{x}_2,\omega')\rangle = 4\pi\hbar\epsilon_0\omega^2\bar{n}(\omega)\delta_{ij}\delta(\omega-\omega')Im\epsilon(\vec{x}_1)\delta(\vec{x}_1-\vec{x}_2) \tag{22}$$

where $$\bar{n}(\omega) = \frac{1}{e^{\frac{\hbar\omega}{k_B T}} - 1}$$

is the Bose-Einstein occupation number. The Kronecker delta function appearing in the isotropic case means no correlation between current in orthogonal directions. For the anisotropic case we need simply to add the indices i, j to the imaginary part of the dielectric function, $Im\epsilon \to Im\epsilon_{ij}$. Writing the vector potential and its corresponding correlation function, $$\vec{A}(\vec{x}, \omega) = \int d\vec{x}\frac{\vec{j}(\vec{x}', \omega)}{|\vec{x} - \vec{x}'|} \tag{23}$$

-continued $$\langle A_i^*(\vec{x_1},\omega)A_j^*(\vec{x_2},\omega')\rangle \propto \int d\vec{x}' \frac{\delta_{ij}\sigma_{ij}}{|\vec{x_1}-\vec{x}'||\vec{x_2}-\vec{x}'|} \tag{24}$$

where we have used the Drude model in three dimensions for the anisotropic case, i.e.

$$Im\epsilon_{ij} = \frac{\sigma_{ij}}{\epsilon_0\omega},$$

and plugged (22) into (23). In order to calculate the correlation function of the magnetic fields we now need to take the curl of the vector potential correlation function, once in respect with $x_1$ and once in respect to $x_2$, as was done in the isotropic case. However due to the tensor form of the conductivity $\sigma_{ij}$ this becomes a bit more cumbersome, and can be written with index formalism as $$\langle B_i^*(\vec{x_1},\omega)B_j(\vec{x_2},\omega')\rangle \propto B_{ij} \equiv \int d\vec{x}' \epsilon_{ilm}\epsilon_{jnp}\partial_{1,l}\partial_{2,n}\frac{\delta_{mp}\sigma_{mp}}{|\vec{x_1}-\vec{x}'|} \tag{25}$$

using the Levi-Civita symbol $\in_{ijk}$ and the regular summation convention over all indices appearing twice. We defined the integral holding the conductivity tensor and the geometry terms as $B_{ij}$ for convenience, and the sign $\partial_{\alpha,l}$ means derivative in respect to $x_\alpha$ in the direction of its $l^{th}$-component. Performing the derivatives we get $$B_{ij} = \int d\vec{x}' \epsilon_{ilm}\epsilon_{jnp}\delta_{mp}\sigma_{mp}\frac{(\vec{x_1}-\vec{x}')_l(\vec{x_2}-\vec{x}')_n}{|\vec{x_1}-\vec{x}'|^3|\vec{x_2}-\vec{x}'|}, \tag{26}$$

as for homogeneous materials, although electrically anisotropic, $\sigma_{ij}$ is not spatially dependent. The $\delta_{mp}$ function greatly simplifies this expression, and in fact for every pair of i, j we need to sum only two integrals. Considering the wire geometry to be such that the atoms are located above the center of a very long wire, the only non-zero elements are $B_{ii}$ for i=1, 2, 3 due to symmetry.

Hence we obtain $$B_{xx}=\sigma_{zz}X_{yy}+\sigma_{yy}X_{zz}$$

$$B_{yy}=\sigma_{zz}X_{xx}+\sigma_{xx}X_{zz}$$

$$B_{zz}=\sigma_{yy}X_{xx}+\sigma_{yy}X_{xx} \tag{27}$$

where $X_{ij}$ is the same spatial integral as in the isotropic case (Eq. (19)). We see that in contrast with the isotropic case, where one has the same conductivity $\sigma_0$ for all three components of $B_{ij}$, here we have differences between each component, and there is a mixing between the direction of the conductivity terms and the spatial terms.

Figure 6:
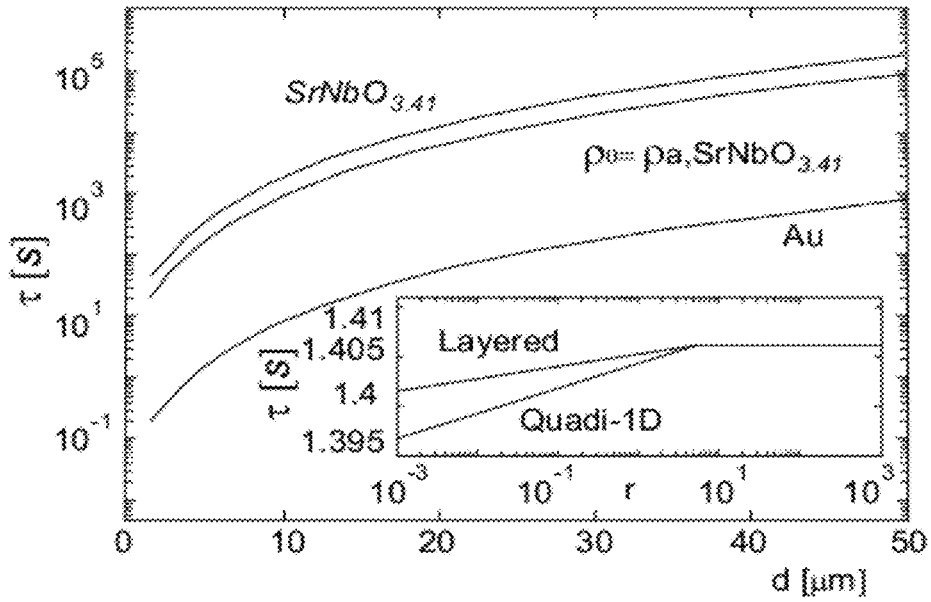
FIG. 6 shows the lifetime dependence on atom-surface distance of an atom micro-trap close to an electrically anisotropic material compared with a similar structure made from Au or an isotropic material with higher electrical resistivity, and also the difference in lifetime dependence on electrical anisotropy between different types of electrically anisotropic materials according to the present invention.

FIG. 6 is Comparison of expected lifetimes of atoms trapped d=5 μm away from a thin metal wire (21) of width W=10 μm and thickness H=2.15 μm, for isotropic Au, anisotropic $SrNbO_{3.41}$, and a calculation for an isotropic material having a resistivity as that of the α-axis of $SrNbO_{3.41}$, according to the present invention. The inset shows the lifetime dependence on anisotropy ratio $$r = \frac{\rho_{0,y}}{\rho_{0,x}}$$

for the same wire geometry, and for the two types of anisotropic materials defined in the text-layered and quasi-1D, according to the present invention.

Comparing the two isotropic cases we see the expected resistivity ratio also in the lifetime, as in this case the lifetime is linearly dependent on resistivity (Eqs. (15) and (20)). No noticeable improvement to the lifetime is achieved using the anisotropic materials (except for a factor on the order of 2 due to the anisotropy), relative to the high-resistivity isotropic material. Looking at the $B_{ij}$ components, we see that $B_{xx}$ is expected to be greatly reduced due to the anisotropy, as it has in it both transverse conductivity components $\sigma_{yy}$,$\sigma_{zz}$ which are much smaller for such materials. However, this does not contribute to the desired improvement in lifetime, as in Eq. (15) $B_{xx}$ is also multiplied by the matrix element $|\langle 0|F_x|f\rangle|^2$ which is zero for our case having the quantization axis along the wire. This is simply the parallel component of the field, and due to the scalar product in the Zeeman interaction $V=-\vec{\mu}\cdot\vec{B}$ it does not contribute. Looking at the other two components of the magnetic correlation function $B_{yy}$ and $B_{zz}$, we find in each term one of low conductivity terms coming from the anisotropy appears, but also the axial term $\sigma_{xx}$ which remains high.

The geometrical factors Xij have been analyzed in detail [16], for the case of rectangular wires. From this analysis it emerges that for any reasonable wire geometry, all of the non-zero Xij factors are on the same order. Thus the main difference in the noise components is due to the difference in conductivity terms, where conductivity $\sigma_{xx}$ is dominant Consequently, the improvement to the trap lifetime using anisotropic materials at room temperature is expected to be at most on the order of 2.

Because of this there is effectively a negligible improvement to the lifetime as seen in FIG. 6. We see that in order to have the $X_{xx}$ term dominant in $B_{yy}$ or $B_{zz}$, the electrical anisotropy is required to 'overcome' the geometrical difference is extremely high, on the order of at least $10^4$-$10^5$. This holds for any reasonable wire configuration commonly used in surface atom optics, when we would like to work close to the surface.

However, the trap lifetime may improve nonetheless by cooling the anisotropic material to cryogenic temperatures, as was the case for certain metal alloys [16].

Figure 7:
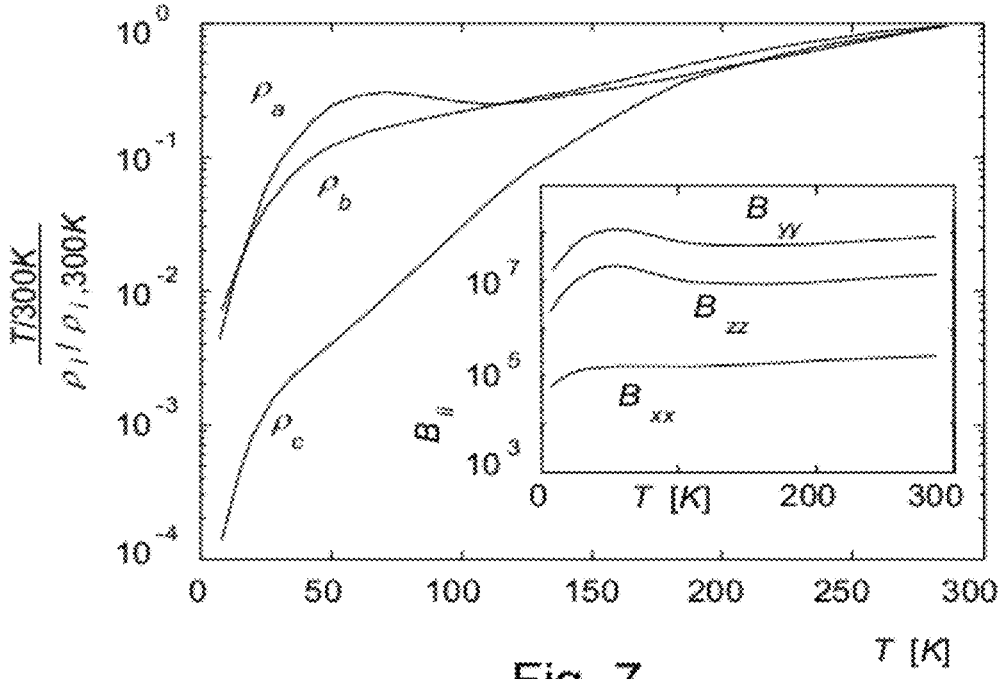
FIG. 7 shows the temperature to electrical resistivity ratio of the electrically anisotropic material $SrNbO_{3.41}$ as a function of working temperature, in each of the three crystalline axes, as well as the resulting component proportional to the magnetic fluctuation cross correlation function according to the present invention.

FIG. 7 shows the temperature dependence of the T/ρ ratio for the electrically anisotropic material $SrNbO_{3.41}$, according to the present invention. This ratio was normalized to that at 300 K, for each of the three crystal axes (i=a, b, c). The inset shows the temperature dependence of the $B_{ii}$ components of the magnetic field correlation function for a thin metal wire (21) of width W=10 μm, thickness H=2.15 μm and atom-surface distance of d=5 μm, according to the present invention. Electrical properties data was taken from [29]. It can be seen that indeed for this material, representative of other anisotropic materials as well, the linear dependence of the resistivity on temperature is not maintained in low temperature.

Figure 8:
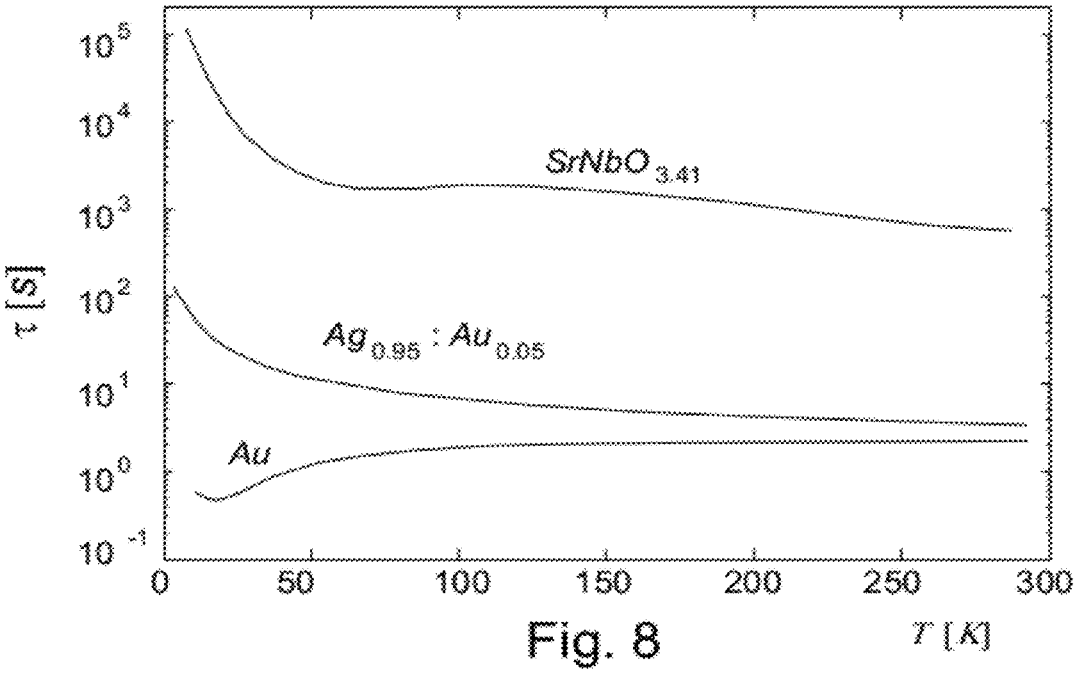
FIG. 8 is a comparison of the trap lifetime dependence on working temperature for isotropic Au, Ag:Au alloy, and electrically anisotropic material $SrNbO_{3.41}$ according to the present invention.

FIG. 8 is the resulting improved trap lifetime upon cooling of the surface, according to the present invention. The comparison is of a standard Au wire with wires of similar geometry made of an Ag:Au alloy [16] and $SrNbO_{3.41}$. We see that for $SrNbO_{3.41}$ an improvement of two orders of magnitude in lifetime is expected upon cooling.

It was already shown (e.g. [2, 5]) that in the case of thermal noise, the important quantity for heating- and decoherence rates is also the magnetic field fluctuation power spectrum, but here only in the direction parallel to the atoms' spin, i.e. the quantization axis.

Following [12], in the case of heating, the heating rate, derived from the same Fermi's Golden Rule formalism, takes the form $$\Gamma_{i\to f} = \frac{\mu_{\parallel}^2}{\hbar^2}\int d^3x d^3x' M_{fi}^*(\vec{x})M_{fi}(\vec{x}')S_{\parallel}(\vec{x},\vec{x}';-\omega_{fi}), \tag{28}$$

where we see in a similar way as in the spin-flip rate equation (Eq. (15)) the wave function overlap integral weighted by the power spectrum, but in the parallel direction, $$S_{\parallel}(\vec{x},\vec{x}';\omega) = \int_{-\infty}^{\infty} dt e^{i\omega t}\sum_{I} p(I)\langle I|B_{\parallel}(\vec{x},t)B_{\parallel}(\vec{x}',0)|\rangle. \tag{29}$$

Hence, in this expression we are interested in the parallel component of the magnetic field correlation function, i.e. of the component $B_{xx}$. We recall that for electrically anisotropic materials this component is indeed reduced considerably, as instead of the isotropic (high) conductivity ($\sigma_{xx}$), here $B_{xx}=\sigma_{zz}X_{yy}+\sigma_{yy}X_{zz}$ (Eq. (29)), containing the two low conductivity components due to the anisotropy. Therefore the heating rate will be reduced by $$\frac{B_{xx}^{aniso}}{B_{xx}^{iso}} = \frac{\sigma_{zz}X_{yy}+\sigma_{yy}X_{zz}}{\sigma_{xx}(X_{yy}+X_{zz})}, \tag{30}$$

assuming $\sigma_0^{(iso)}=\sigma_{xx}$. For narrow wires this tends to $$\frac{\sigma_{yy}}{\sigma_{xx}},$$

that is, scaling as the anisotropy ratio. For wider wires this expression tends again to the same anisotropy ratio unless in the case of quasi-1D materials where $\sigma_{zz}>>\sigma_{yy}$, then the reduction factor to the heating rate tends to $$\frac{\sigma_{zz}}{\sigma_{xx}}.$$

As an example we again look at $SrNbO_{3.41}$ at room temperature. Assuming the highest conductivity is again along the wire, and the lowest along its width, we find $$\frac{\sigma_{yy}}{\sigma_{xx}} < 0.02,$$

and $$\frac{\sigma_{zz}}{\sigma_{xx}}$$

is even smaller. Hence we expect a strong suppression of the heating rate as the anisotropy grows, for both types of anisotropic materials. It should be noted that heating due to thermal noise is commonly considered less important than heating as a result of technical instabilities in the electronics providing the currents in the experiments (technical noise, usually a few orders of magnitude stronger than thermal noise in regards to heating [2]). However it is expected that as ultra-low-noise technology will advance, heating from thermal noise will become more dominant, and hence using electrically anisotropic materials should significantly help in suppressing this heating mechanism. Henkel et al. (e.g. [12]) have also shown that the decoherence rates due to thermal noise depend on the same power spectrum (30). For spin coherence the decoherence rate was shown to be $$\gamma_{spin} = \frac{\Delta\mu_{\parallel}^2}{2\hbar^2}S_{\parallel}(\vec{r};0), \tag{31}$$

where the differential magnetic moment $\Delta\mu_{\parallel}=\langle m_2|\mu_{\parallel}|m_2\rangle-\langle m_1|\mu_{\parallel}|m_1\rangle$, $m_1$, $m_2$ being the two spin states of a superposition, and $S_{\parallel}(\vec{r};0)$ the low-frequency limit of the parallel noise spectrum of the thermal noise.

The spatial decoherence rate was shown to be $$\gamma_{spatial} = \frac{\mu_{\parallel}^2}{\hbar^2}S_{\parallel}(\vec{r};-\omega_{fi}), \tag{32}$$

where we again find the same parallel power spectrum. Hence also for decoherence the suppression of the harmful mechanism is expected to be the same as for heating (Eq. (31)). In the isotropic case it is clearly seen from these rates that the decoherence rate is on the order of the spin-flip loss rate (Eqs. (15), and (20)). For anisotropic materials an interesting situation arises, where while the spin-flip loss rate stays unchanged, a significant improvement for decoherence rates can be achieved. This would be of interest for interferometry experiments, where atom number may not be the important quantity. Note also that combined with cooling the surface, as discussed in above, an improvement both to lifetime and to decoherence and heating rates can be achieved.

We now turn to discuss a few more practical issues regarding the implementation of the above theory. We start by presenting a partial review of electrically anisotropic materials which may be considered as potential candidates for experiments to test the theory and perhaps be used for further experiments, and then proceed to more specific issues relevant to fragmentation or noise experiments.

Electrically anisotropic materials have been studied mostly in the context of characterizing their electrical transport properties (e.g. as a function of temperature or fabrication methods and parameters), or their magnetic properties. A large portion of these materials are also high-$T_C$ superconductors, hence they are also interesting in that context. Here we present some materials, but by no means a complete survey.

Table 1 shows the relevant electrical properties of some anisotropic materials.

TABLE 1

| Material Class | Material | $\rho_c/\rho_\alpha$ | $\rho_c/\rho_b$ | $\rho_\alpha/\rho_b$ | Magnetic properties | UHV compatibility | Data source |
|---|---|---|---|---|---|---|---|
| hop metals | Sc | 0.37 | | | Paramagnetic | | [13] |
| | Ga | 3.21 | 7.07 | 2.2 | | | |
| | Te | 3.64 | | | | | |
| Layered compounds | $LaSb_2$ | 16.55 | | | Paramagnetic | | |
| | Sr2RuO4 | 50-300 | | | Paramagnetic | + | [14-17] |
| | $Sr_3Ru_2O_7$ | 23.5 | | | | | [18] |
| | $NaCo_2O_4$ | 42.11 | | | | | |
| Ladder-spin compounds | $Ca_{14}Cu_{24}O_{41}$ | 0.01 | | | | | |
| | $Sr_3Ca_{11}Cu_{24}O_{41}$ | 0.1 | $10^{-5}$ | $10^{-4}$ | Paramagnetic | | [19] |
| Cuprates | Bi2212 | $0.5 \cdot 10^4$ | | | | | [20] |
| | YBCO | 25-60 | | | | − | [21] |
| | $La_{2-m}Sr_mCuO_4$ | 100-360 | | | | | |
| Graphite | Natural single crystal | 105 | | | Nonmagnetic | + | [12] |
| | HOPG | 3750 | | | Nonmagnetic | + | [22] |
| Perovskites | $LaTiO_{3.41}$ | $8.75 \cdot 10^4$ | 850 | $10^{-2}$ | | | [23] |
| | $SrNbO_{3.41}$ | $3 \cdot 10^3$ | 50 | $2 \cdot 10^{-2}$ | | | [24] |

Electrically Anisotropic Materials as Potential Candidates for Surface Atom Optics Although some hexagonal metals exhibit anisotropy, that is usually smaller than a factor of 4. Higher anisotropy ratios can be found in several layered compounds, as well as in some ladder-spin compounds, also shown in the table. A possible problem using these layered compounds lies in their being paramagnetic, which is less preferable for constructing magnetic traps (although it is certainly possible to work even with permanent magnets for atom trapping, e.g. [13]). Compatibility to ultra-high vacuum (UHV) conditions is also an important requirement. For example, YBCO is known for having a degradation of its electrical properties as the oxygen content in the ambient atmosphere is reduced. A possible solution for this problem is to deposit a very thin layer of buffer layer, e.g. 10 nm thick $SiO_2$, between the YBCO surface and the vacuum, to shield the sensitive material. We note here especially different types of graphite, which seem to be attractive candidates for atom optics. Natural single crystal graphite, as was studied in [17], exhibits anisotropy of r≈100, while being nonmagnetic, and UHV compatible. Highly oriented pyrographite (HOPG) is a form of synthetic single crystal graphite, which exhibits a very high (layered) anisotropy of up to r≈3500. This comes without sacrificing much the good conductance along the wire, which is comparable for example to that of Ti, one order of magnitude more than Au or Cu. However, the fabrication of wire-sized structures out of graphite may be a challenge, due to the hardness of this material.

Materials with quasi-1D conductance are harder to come by, however some examples can be found nonetheless. In Table 1 we list as an example two materials of similar properties, which exhibit such properties. The Perovskite-related transition-metal oxides $SrNbO_{3.41}$, $LaTiO_{3.41}$ present relatively high conductivity only in one direction (resistivity in the mid $10^{-1}$ to high $10^{-6}$ Ohm range, significantly higher than regular metals which are typically 1-2 orders of magnitude better, but still lower than typical semiconductors). The case here is the more extreme quasi-1D material type discussed above, as we do not have $\rho_{0,y} \gg \rho_{0,x}$ and $\rho_{0,z} \approx \rho_{0,y}$, but in fact $\rho_{0,z} \gg \rho_{0,y} \gg \rho_{0,x}$. Up to fabrication limitations, there is also the freedom to choose the alignment of the two badly conducting crystal axis along the width or thickness of the wire.

Perhaps the most difficult practical issue to address in regards to fragmentation experiments with electrically anisotropic materials is whether it is possible to fabricate wire-sized structures out of them. Handling single crystals is harder than polycrystalline or amorphous materials. The common size of grown crystals is usually large in respect to wire dimensions, and cleaving along crystalline planes is in principle possible, but technically complicated when going down to micron sized width and thickness.

Studying the materials in the table along with the figures presented above, we see that the hexagonal metals cannot be considered as good candidates for suppression of fragmentation and control over the preferred orientation of current patterns, as their low anisotropy (r≈4) would probably not be high enough to distinguish from the isotropic case (leading to $\theta_{max} \approx 60°$ while suppressing the overall signal by factor 2), taking into account issues such as signal-to-noise ratio of the measured density profile, and other effects such as the atoms' temperature and observation height. Using graphite, where the anisotropy is 100 or even≈3500 in the case of HOPG, is expected to result in a preferred angle of $\theta_{max} \approx 85°$, and a suppression of the signal by a factor 10-100. The much weaker signal should still be resolvable, assuming the signal-to-noise ratio is on the order of $$\frac{\Delta B}{B} \approx 10^{-6}$$

in the isotropic case [14], while the change in the angle should certainly be distinguishable.

The temperature dependence of the electrical properties of some materials may allow performing an interesting experiment where the preferred pattern angle and overall fragmentation suppression changes with temperature. As can be seen from FIG. 3 the desired material should have at one point in the temperature range an anisotropy ratio of r≧30, while at another point having r<4, between these values the most pronounced difference in the preferred angle is expected to be obtained. For such a material a wire mapping at the same atom-surface distance can be performed at different temperatures, and the evolution of the suppression of fragmentation, as well as the change of preferred pattern orientation, could be observed over a single structure.

In regards to noise, the preferable materials would those of the highest possible anisotropy, and of the extreme quasi-1D conductance type. Using HOPG or the perovskite materials will lead to a reduction to heating and decoherence rate by a factor of $>10^3$. An important practical issue that may hinder on the improved noise rates from thermal noise is the heating of wires when current is applied. Whereas in principle for investigation of thermal noise itself no current is needed in the probed surface structure, when considering an actual experiment with a magnetic micro-trap, there will be current in the structures.

As was shown in [15], [16], running current in a mirco-structured wire results in heating of the wire, according to two processes, the first fast and the second slow. As can be seen from the prefactor of the magnetic field power spectrum (20), this heating would affect the noise rates as well, depending linearly on the surface temperature. Baring in mind that most anisotropic materials have a lower conductivity along the wire $\sigma_{xx}$ in respect to metals, this implies that running a current through an anisotropic material wire would hurt the improved noise rates.

Figure 9:
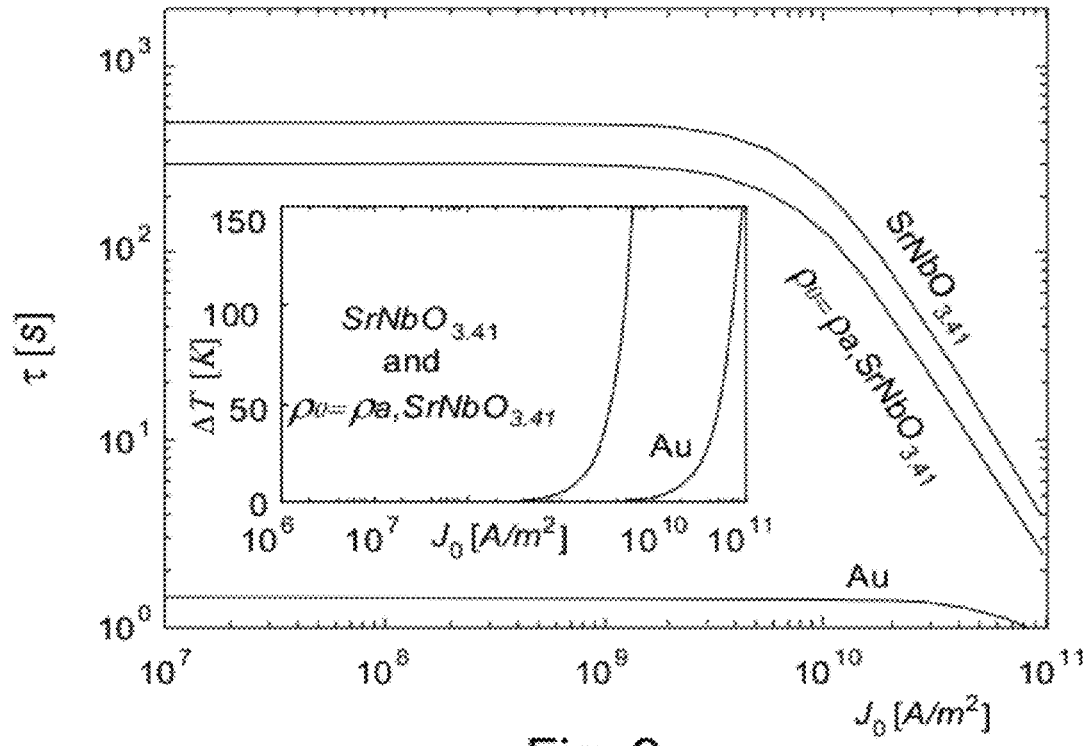
FIG. 9 is a comparison of the lifetime of a conductive element carrying a current density between isotropic Au, electrically anisotropic $SrNbO_{3.41}$, and a high-resistivity isotropic material according to the present invention.

FIG. 9 is a plot of lifetime as a function of applied current density $J_0$ along the thin metal wire (21), according to the present invention. For $J_0=0$ the lifetime from pure thermal noise, without any heating to the wire, is obtained. As the current density is increased above $10^9$ A/m$^2$ it is shown that due to wire heating the lifetime drops significantly. Anisotropic materials behave in the same way as isotropic materials of equal conductivity along the wire up to a factor on the order of 2 due to the anisotropy. The inset show the temperature rise (above 300 K) of the wire as the external current density is increased. Wire parameters were width W=10 μm, thickness H=2.15 μm, and atom-surface distance of d=5 μm.

This was plotted taking into account wire heating according to the model developed by Groth et al. [15]. As the relevant component to the heating process is the applied current, there is no difference between an anisotropic material and an isotropic one with the same conductivity as that of the anisotropic material along the wire, $\sigma_0^{iso}=\sigma_{xx}^{aniso}$ up to a factor on the order of 2 due to the anisotropy. In respect to a metallic wire the ratio of conductivities is exhibited also in the lifetime, up to current densities of $10^9$ A/m$^2$. For higher current densities we see that materials with low conductivity heat up much more than metallic ones (shown in the inset), and the corresponding lifetime drops by two orders of magnitude for current densities of up to $10^{11}$ A/m$^2$, which is considered a high limit for small metallic wires [15]. The conclusion here is that although electrically anisotropic materials are promising candidates for reducing noise rates, their advantages can be utilized only in small to moderate current densities. This should not pose overly stringent restrictions on possible experiments, as at small atom-surface distances the required currents for small and tight traps are not very high.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An atom chip device for trapping, manipulating and measuring atoms in an ultra high vacuum chamber, for reducing heating and decoherence rates, for increasing the lifetime of the trapped atoms, and for suppression of atom cloud fragmentation, the atom chip device comprising:

(a) at least one atom chip conductive element, having a flat surface, wherein said at least one atom chip conductive element is made of metal, wherein at least part of said atom chip conductive element is an electrically anisotropic material, and wherein said at least one conductive element has a working temperature, and said electrically anisotropic material has, at said working temperature, lower resistivity and temperature/resistivity ratio values than both resistivity and temperature/resistivity ratio values of gold at room temperature.

2. The atom chip device of claim 1, wherein said reduction of heating and decoherence rates, of said trapped atoms compared with those achievable by using atom chip device having conductive elements made of pure metals is at least smaller by a factor of 100, the atom chip device further comprising:

(b) an atom chip functional layer, having a flat surface, wherein said atom chip functional layer is made of metal, wherein at least part of said metal is made of an electrically anisotropic material, and wherein said atom chip functional layer is isolated electrically from said conductive element.

3. The atom chip device of claim 2 further comprising:

(c) an atom chip substrate, wherein said atom chip substrate gives mechanical strength to said atom chip device; and (d) an atom chip insulated layer, disposed on said atom chip substrate, wherein said atom chip insulated layer electrically insulates said at least one conductive element from said functional layer.

4. The atom chip device of claim 2, wherein said at least one atom chip conductive element's flat surface and said functional layer's flat surface are substantially on the same plane.

5. The atom chip device of claim 2, wherein said at least one atom chip conductive element's flat surface and said functional layer's flat surface are substantially on different planes.

6. The atom chip device of claim 1 further comprising:

(e) at least two atom chip conductive elements, having flat surfaces.

7. The atom chip device of claim 2 wherein said atom chip conductive element and said atom chip functional layer are both substantially made of said electrically anisotropic material.

8. The atom chip device of claim 1 wherein said at least one atom chip conductive element's working temperature is less than room temperature.

9. The atom chip device of claim 1 wherein said at least one atom chip conductive element has a geometric shape selected from a group consisting of a straight line, Z-shape, conveyer belt shape, or U-shape.

10. The atom chip device of claim 1 wherein said at least one atom chip conductive element has a geometric Z-shape.

11. The atom chip device of claim 1 wherein said at least one atom chip conductive element has a geometric U-shape.

12. The atom chip device of claim 1 wherein said at least one conductive element has a geometric conveyer belt shape.

13. The atom chip device of claim 1 wherein said at least one atom chip conductive element's electrically anisotropic material is made of hyper-oriented pyro-graphite (HOPG), having anisotropy ratio $\rho_c/\rho_a$ of approximately 3750 at room temperature.

14. The atom chip device of claim 1 wherein said at least one atom chip conductive element's electrically anisotropic material is made of $SrNbO_{3.41}$, having an a-axis resistivity of $\rho_a=4.6\cdot10^{-4}$ Ωcm and anisotropy ratio $\rho_a:\rho_b:\rho_c$ of approximately $1:10^2:10^4$ at room temperature (300K), and $\rho_a=2.7\cdot10^{-3}$ Ωcm and anisotropy ratio $\rho_a:\rho_b:\rho_c$ of approximately $1:37:10^5$ at approximately 7.5 K.

15. An atom chip device for trapping, manipulating and measuring atoms in ultra high vacuum chamber, for reducing of heating- and decoherence-rates and for increasing the lifetime of the trapped atoms, the atom chip device comprising:

(a) at least one atom chip conductive element, having a flat surface, wherein said at least one atom chip conductive element is made of metal, wherein at least part of said metal is an electrically anisotropic material, and wherein said at least one atom chip conductive element has a working temperature, wherein said at least one atom chip conductive element working temperature is less than room temperature, wherein said at least one atom chip conductive element has a geometric shape selected from a group consisting of a straight line, Z-shape, conveyer belt shape, or U-shape, and wherein said at least one atom chip conductive element's is made of an electrically anisotropic material having both resistivity and temperature/resistivity ratio values at said working temperature lower than both resistivity and temperature/resistivity ratio values of gold at room temperature;

(b) an atom chip functional layer, having a flat surface, wherein said atom chip functional layer is made of metal, wherein at least part of said metal is an electrically anisotropic material, and wherein said atom chip functional layer is electrically isolated from said conductive element;

(c) an atom chip substrate, wherein said atom chip substrate gives mechanical strength to said atom chip device; and (d) an atom chip's first insulated layer, disposed on said substrate, wherein said atom chip's first insulated layer electrically insulates said at least one conductive element from said functional layer.

16. The atom chip device of claim 15 wherein said at least one atom chip's first conductive element's electrically anisotropic material is made of hyper-oriented pyro-graphite (HOPG), having anisotropy ratio $\rho_c/\rho_a$ of approximately 3750 at room temperature.

17. The atom chip device of claim 15 wherein said at least one atom chip's first conductive element's electrically anisotropic material is made of $SrNbO_{3.41}$, having an a-axis resistivity of $\rho_a=4.6\cdot10^{-4}$ Ωcm and anisotropy ratio $\rho_a:\rho_b:\rho_c$ of approximately $1:10^2:10^4$ at room temperature (300K), and $\rho_a=2.7\cdot10^{-3}$ Ωcm and anisotropy ratio $\rho_a:\rho_b:\rho_c$ of approximately $1:37:10^5$ at approximately 7.5 K.

18. A method of trapping, manipulating and measuring atoms comprising the stages of:

(a) providing an atom chip device including:

(i) at least one atom chip conductive element, having a flat surface, wherein said at least one atom chip conductive element is made of metal, wherein at least part of said metal is an electrically anisotropic material, wherein said at least one atom chip conductive element has a working temperature, wherein said at least one atom chip conductive element working temperature is less than room temperature, wherein said at least one atom chip conductive element has a geometric shape selected from a group consisting of a straight line, Z-shape, conveyer belt shape, or U-shape, and wherein said at least one conductive element's dilute alloy metal is made of an alloy having both resistivity and temperature/resistivity ratio values at temperature lower than both resistivity and temperature/resistivity ratio values of gold at room temperature;

(ii) an atom chip functional layer, having a flat surface, wherein said atom chip functional layer is made of metal, wherein at least part of said metal is an electrically anisotropic material, and wherein said functional layer is electrically isolated from said conductive element;

(iii) an atom chip substrate, wherein said atom chip substrate gives mechanical strength to said atom chip device; and (iv) an atom chip's first insulated layer, disposed on said atom chip substrate, wherein said atom chip's first insulated layer electrically insulates said at least one atom chip's first conductive element from said functional layer;

(b) installing said atom chip device inside a chamber, at room temperature and at room pressure, wherein said chamber has the structure of an ultra high vacuum chamber;

(c) closing and sealing said chamber;

(d) lowering the pressure inside said chamber;

(e) supplying atoms to the inside of said chamber; and (f) connecting said at least one atom chip's first conductive element to an electricity source.

19. The method of claim 18, further comprising the stage of:

(g) lowering the temperature of said at least one atom chip's first conductive element.

* * * * *